US009001111B2

(12) United States Patent
Mizusako et al.

(10) Patent No.: US 9,001,111 B2
(45) Date of Patent: Apr. 7, 2015

(54) LIQUID CRYSTAL DISPLAY DEVICE, DRIVING METHOD FOR THE LIQUID CRYSTAL DISPLAY DEVICE, AND ELECTRONIC APPARATUS

(75) Inventors: Kazuhisa Mizusako, Shiojiri (JP); Hitoshi Sasaki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 196 days.

(21) Appl. No.: 13/612,133

(22) Filed: Sep. 12, 2012

(65) Prior Publication Data

US 2013/0069928 A1 Mar. 21, 2013

(30) Foreign Application Priority Data

Sep. 15, 2011 (JP) ..... 2011-202251

(51) Int. Cl.
*G09G 5/00* (2006.01)
*G09G 3/36* (2006.01)

(52) U.S. Cl.
CPC ..... *G09G 3/3614* (2013.01); *G09G 3/3611* (2013.01); *G09G 2300/0413* (2013.01); *G09G 2310/0224* (2013.01); *G09G 2310/08* (2013.01); *G09G 2320/0204* (2013.01); *G09G 2320/0247* (2013.01)

(58) Field of Classification Search
CPC . G09G 3/3614; G09G 3/2803; G09G 3/3611; G09G 2320/0247; G09G 2320/0204; G09G 2300/0413; G09G 2310/08; G06F 3/038
See application file for complete search history.

(56) References Cited

U.S. PATENT DOCUMENTS

2010/0073341 A1* 3/2010 Toyooka et al. ..... 345/208
2010/0079441 A1 4/2010 Sasaki et al.
2010/0309183 A1 12/2010 Mizusako
2010/0309189 A1* 12/2010 Mizusako et al. ..... 345/212

FOREIGN PATENT DOCUMENTS

JP 08-286169 A 11/1996
JP 2010-079151 A 4/2010
JP 2010-281934 A 12/2010

* cited by examiner

*Primary Examiner* — Lixi C Simpson
(74) *Attorney, Agent, or Firm* — Maschoff Brennan

(57) ABSTRACT

A liquid crystal display device according to the invention has an effect that burn-in and a flicker do not occur. Dummy pixels are provided around pixels of the liquid crystal display device. A first voltage higher in order than a reference voltage and a second voltage lower in order than the first voltage are applied to a pixel electrode of a liquid crystal device included in the dummy pixel while being temporally shifted. The liquid crystal display device changes, on the basis of an electric current flowing to a second opposed electrode when the first voltage is applied and an electric current flowing to the second opposed electrode when the second voltage is applied, a ratio of effective voltages of a positive voltage and a negative voltage applied to a liquid crystal device included in the pixel that displays an image.

17 Claims, 17 Drawing Sheets

LIQUID CRYSTAL DISPLAY DEVICE, DRIVING METHOD FOR THE LIQUID CRYSTAL DISPLAY DEVICE, AND ELECTRONIC APPARATUS

BACKGROUND

1. Technical Field

The present invention relates to a technique for preventing burn-in and a flicker from occurring.

2. Related Art

In a liquid crystal display device, in general, a liquid crystal device is AC-driven. However, when the liquid crystal device is simply AC-driven, a direct-current component is sometimes applied to liquid crystal. Specifically, in the liquid crystal display device, a pixel electrode substrate and an opposed electrode substrate provided across a liquid crystal layer have different physical structures. On an interface of an electrode and an orientated film and an interface of the oriented film and the liquid crystal layer, resistance is different when a positive voltage higher in order with respect to the opposed electrode is applied to the pixel electrode substrate and when a negative voltage lower in order with respect to the opposed electrode is applied. Consequently, in the liquid crystal display device, even if an effective voltage applied to the liquid crystal layer is equal when the positive voltage is applied and when the negative voltage is applied, a current amount is different and asymmetry occurs in the movement of charges. Because of the asymmetry of the current amount, a bias occurs in charges in the liquid crystal. An internal electric field is generated by the bias of the charges. Because of the influence of the internal electric field, a voltage actually applied to the liquid crystal layer becomes asymmetry according to the polarity of a driving voltage. A direct-current voltage component is applied to the liquid crystal layer.

When the direct-current voltage component is applied to the liquid crystal layer, a flicker occurs. Therefore, there is a technique for adjusting the voltage of the opposed electrode in order to prevent the flicker. For example, an adjusting circuit disclosed in JP-A-8-286169 measures, with an optical sensor, luminance obtained when the positive voltage is applied to the liquid crystal device and luminance obtained when the negative voltage is applied to the liquid crystal device and adjusts the voltage of the opposed electrode on the basis of a difference between the luminance obtained when the positive voltage is applied and the luminance obtained when the negative voltage is applied.

Even if the voltage of the opposed electrode is adjusted by the adjusting circuit disclosed in JP-A-8-286169 to minimize the flicker, the direct-current voltage component is applied to the liquid crystal device because of aged deterioration and burn-in occurs. In this case, an operator operates the adjusting circuit again to cause the adjusting circuit to adjust the voltage of the opposed electrode. This is time-consuming.

SUMMARY

An advantage of some aspects of the invention is to prevent burn-in and a flicker from occurring.

An aspect of the invention is directed to a liquid crystal display device including: a display pixel in which liquid crystal is held between a first electrode and a common electrode; a driving circuit that temporally alternately applies, to the first electrode, a positive voltage further on a high-order side than a predetermined reference voltage and corresponding to the gradation of the display pixel and a negative voltage further on a low-order side than the predetermined reference voltage and corresponding to the gradation and applies a predetermined voltage to the common electrode; a dummy pixel in which liquid crystal is held between a second electrode and the common electrode; a measuring signal circuit that supplies, to the second electrode, a measuring signal for applying the first voltage further on the high-order side than the reference voltage and the second voltage further on the low-order side than the reference voltage while temporally shifting the first and second voltages; and a control circuit that changes a ratio of effective voltages of the positive voltage and the negative voltage, which are applied to the first electrode by the driving circuit, on the basis of a first electric current obtained by excluding an instantaneous current due to the application of the first voltage from an electric current flowing to the common electrode after the first voltage is applied to the second electrode and a second electric current obtained by excluding an instantaneous current due to the application of the second voltage from an electric current flowing to the common electrode after the second voltage is applied to the second electrode.

According to the aspect of the invention, the ratio of the effective voltages of the positive voltage and the negative voltage applied to the first electrode of the display pixel is changed on the basis of the first electric current obtained by excluding the instantaneous current due to the application of the first voltage from the electric current flowing to the common electrode after the first voltage is applied to the second electrode from the measuring signal circuit and the second electric current obtained by excluding the instantaneous current due to the application of the second voltage from the electric current flowing to the common electrode after the second voltage is applied to the second electrode. Therefore, it is possible to prevent a direct-current voltage component from being applied to the liquid crystal and prevent burn-in and a flicker from occurring in the liquid crystal display device.

The liquid crystal display device of the aspect of the invention may be configured such that the control circuit changes the ratio of the effective voltages of the positive voltage and the negative voltage applied to the first electrode to reduce a difference between the first electric current and the second electric current to be smaller than a predetermined threshold.

With this configuration, the ratio of the effective voltages of the positive voltage and the negative voltage applied to the first electrode is changed on the basis of the difference between the first electric current flowing when the first voltage is applied to the liquid crystal of the dummy pixel and the second electric current flowing when the second voltage is applied to the liquid crystal. Therefore, it is possible to prevent burn-in and a flicker from occurring.

The liquid crystal display device of the aspect of the invention may be configured such that the control circuit changes application times of the positive voltage and the negative voltage applied to the first electrode to reduce a difference between the first electric current and the second electric current to be smaller than a predetermined threshold.

With this configuration, the effective voltage of the positive voltage and the effective voltage of the negative voltage are changed. Therefore, it is possible to prevent burn-in and a flicker from occurring.

The liquid crystal display device of the aspect of the invention may be configured such that the control circuit changes a voltage ratio of the positive voltage and the negative voltage applied to the first electrode to reduce a difference between the first electric current and the second electric current to be smaller than a predetermined threshold.

With this configuration, the ratio of the positive voltage and the negative voltage is changed, whereby the effective voltage of the positive voltage and the effective voltage of the negative voltage are changed. Therefore, it is possible to prevent burn-in and a flicker from occurring.

The liquid crystal display device of the aspect of the invention may be configured such that the measuring signal is a signal for applying a third voltage, which is the same as the voltage applied to the common electrode, to the second electrode between a period in which the first voltage is applied and a period in which the second voltage is applied.

With this configuration, an optical response of the liquid crystal is delayed when the first voltage is applied and when the second voltage is applied. Therefore, it is possible to easily obtain the first electric current and the second electric current.

The liquid crystal display device of the aspect of the invention may be configured such that the common electrode includes a first common electrode that holds the liquid crystal between the first common electrode and the first electrode and a second common electrode that holds the liquid crystal between the second common electrode and the second electrode. The first common electrode and the second common electrode are insulated from each other. The control circuit changes the ratio of the effective voltages of the positive voltage and the negative voltage, which are applied to the first electrode by the driving circuit, on the basis of an electric current obtained by excluding an instantaneous current due to the application of the first voltage from an electric current flowing to the second common electrode after the first voltage is applied to the second electrode and an electric current obtained by excluding an instantaneous current due to the application of the second voltage from an electric current flowing to the second common electrode after the second voltage is applied to the second electrode.

With this configuration, it is possible to measure an electric current flowing to the liquid crystal of the dummy pixel separately from the display pixel.

The liquid crystal display device of the aspect of the invention may be configured such that a period in which the first voltage of the measuring signal is applied to the second electrode is longer than a period in which the positive voltage is applied to the first electrode. A period in which the second voltage of the measuring signal is applied to the second electrode is longer than a period in which the negative voltage is applied to the first electrode.

With this configuration, it is possible to secure time for obtaining the first electric current and the second electric current and easily obtain the first electric current and the second electric current.

The liquid crystal display device of the aspect of the invention may be configured such that in the dummy pixel, the measuring signal is supplied to the second electrode from the measuring signal circuit in a predetermined period and, outside the period, the positive voltage and the negative voltage applied to the display pixel adjacent to the dummy pixel are temporally alternately applied to the second electrode from the driving circuit.

With this configuration, it is possible to set the dummy pixel to gradation same as the gradation of the display pixel adjacent thereto and make the dummy pixel less conspicuous.

The invention can be conceptualized not only as an electro-optical device but also as a driving method for a liquid crystal display device and as an electronic apparatus including the liquid crystal display device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment

First, an embodiment of the invention is schematically explained. In a liquid crystal device in which liquid crystal is held between a pixel electrode and an opposed electrode (a common electrode), in order to prevent burn-in and deterioration, a positive voltage further on a high-order side than a reference voltage and a negative voltage further on a low-order side than the reference voltage are alternately applied to the pixel electrode and, on the other hand, a predetermined voltage is applied to the opposed electrode to AC-drive the liquid crystal device. At this point, if the transmittance (or the reflectance) of the liquid crystal device is different in a period in which a voltage is applied and retained at positive polarity and a period in which a voltage is applied and retained at negative polarity, the difference is sensed as a flicker (blinking).

The tilt of liquid crystal molecules changes according to an electric field generated between the pixel electrode and the opposed electrode. According to the change in the tilt, a polarization state of light passing through the liquid crystal device is specified and the transmittance (or the reflectance) of the liquid crystal device changes. Since the liquid crystal has dielectric anisotropy, if the transmittance of the liquid crystal device is different in the retaining period of the positive voltage and the retaining period of the negative voltage, the tilt of the liquid crystal molecules is different. This surely means that the capacity of the liquid crystal device is different.

Therefore, if the capacities of the liquid crystal device are detected for the respective retaining periods of the positive voltage and the negative voltage and the voltage applied to the liquid crystal device is controlled to reduce a difference between the capacities, the flicker should be able to be reduced. However, it is difficult to directly detect the capacity of the liquid crystal device. Therefore, in this embodiment, as explained below, an electric current flowing to the liquid crystal device to correspond to the capacity of the liquid crystal device is measured and the voltage applied to the liquid crystal device is controlled on the basis of the measured electric current. This embodiment is materialization of this configuration. Details of the embodiment are explained below.

Figure 1:
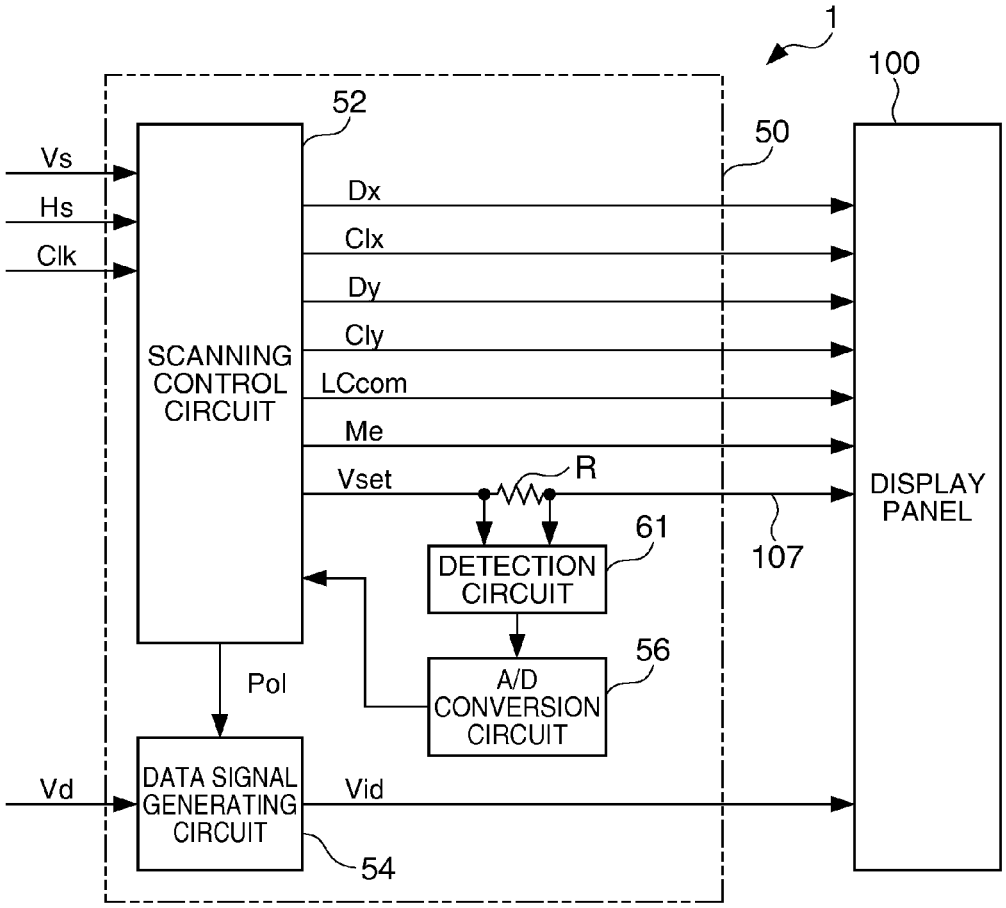
FIG. 1 is a block diagram showing the configuration of an electro-optical device.

FIG. 1 is a block diagram showing the configuration of an electro-optical device 1 (a liquid crystal display device) according to an embodiment of the invention. As shown in FIG. 1, the electro-optical device 1 is roughly divided into a display panel 100 and a control circuit 50. The control circuit 50 that controls, for example, the operation of the display panel 100 includes a scanning control circuit 52, a data signal generating circuit 54, an A/D conversion circuit 56, a detection circuit 61, and a resistance element R. The control circuit 50 is connected to the display panel 100 by, for example, an FPC (flexible printed circuit) board.

The control circuit 50 controls sections of the display panel 100 according to a vertical synchronization signal Vs, a horizontal synchronization signal Hs, and a clock signal Clk supplied from an external host circuit (not shown in the figure). The control circuit 50 converts digital image data Vd supplied from the external upper-level circuit into an analog data signal Vid and supplies the data signal Vid to the display panel 100. Details of the control circuit 50 are explained below.

Figure 2:
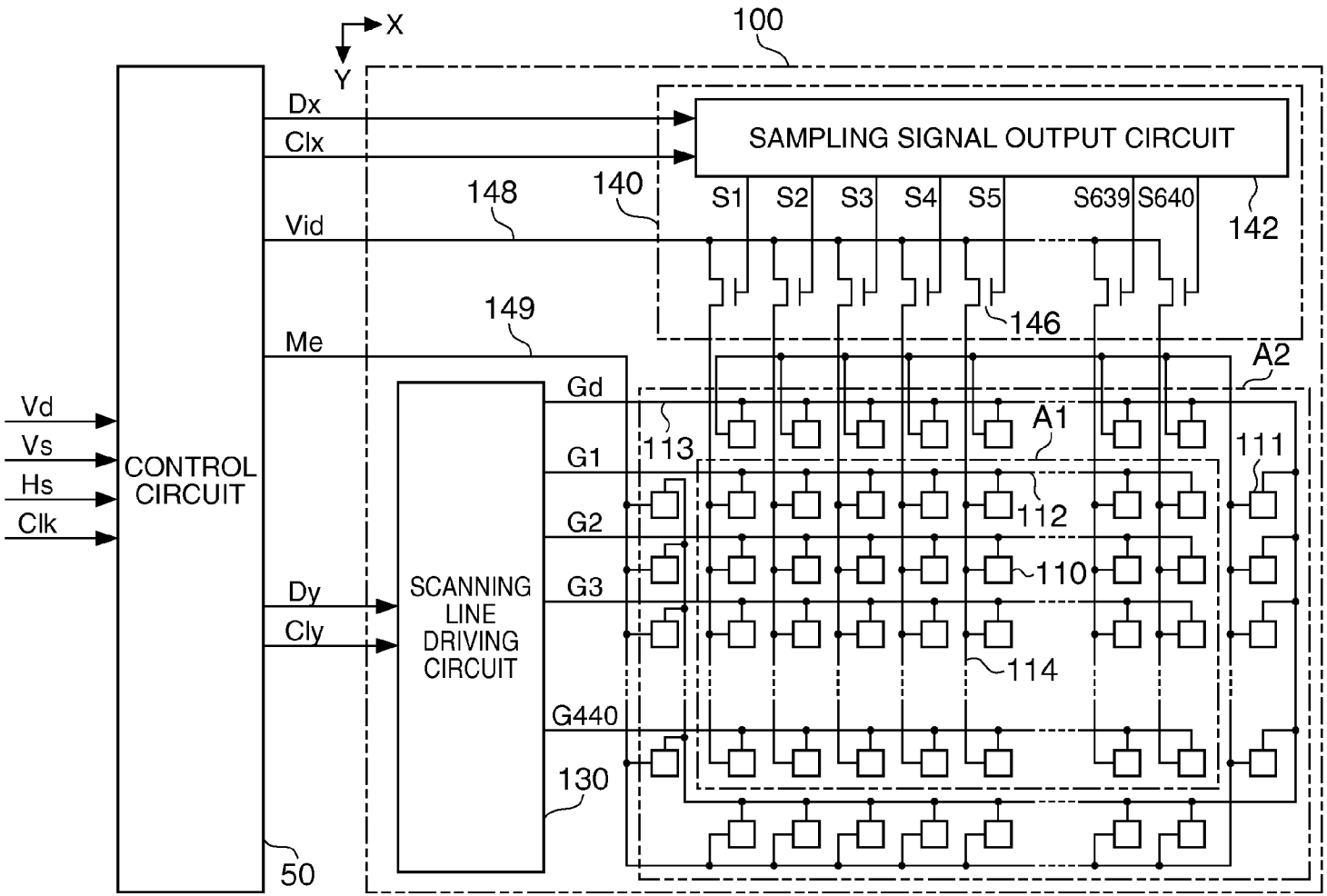
FIG. 2 is a diagram showing the configuration of a display panel.

FIG. 2 is a diagram showing the configuration of the display panel 100. The display panel 100 displays an image using liquid crystal. The display panel 100 includes a display area A1 for displaying an image and a dummy pixel area A2 provided around the display area A1. The display panel 100 is a peripheral circuit built-in type in which a scanning line driving circuit 130 and a data line driving circuit 140 are arranged around the dummy pixel area A2.

In the display area A1, scanning lines 112 in 480 rows are provided in the lateral direction (the X direction) in the figure and data lines 114 in 640 columns are provided in the longitudinal direction (the Y direction) in the figure. Pixels 110 (display pixels) are respectively provided to correspond to intersections of the scanning lines 112 and the data lines 114. In this embodiment, the pixels 110 are arrayed in a matrix shape of 480 rows×640 columns in the display area A1. However, this does not mean that the invention is limited to this array.

In the dummy pixel area A2, plural dummy pixels 111 are arranged to surround the display area A1. A scanning line 113 and a measuring signal line 149 provided to surround the display area A1 are connected to the dummy pixels 111. Specifically, in this embodiment, the dummy pixels 111 are provided in 1 row×640 columns adjacent to the pixels 110 in the first row and provided in 1 row×640 columns adjacent to the pixels 110 in the 480th row. The dummy pixels 111 provided in 1 column×480 rows adjacent to the pixels 110 in the first column and provided in 1 column×480 rows adjacent to the pixels 110 in the 640th column.

The scanning line driving circuit 130 is controlled by the control circuit 50 to supply scanning signals G1, G2, G3, . . . , and G480 respectively to the scanning lines 112 in the first, second, third, . . . , and 480th rows over a vertical scanning period. The scanning line driving circuit 130 selects the scanning lines 112 for each horizontal scanning period in predetermined order and sets a scanning signal supplied to the selected scanning lines 112 to an H level (a selected voltage) equivalent to a voltage Vdd.

The scanning line driving circuit 130 is controlled by the control circuit 50 to supply a scanning signal Gd to the scanning line 113. When an electric current flowing to the liquid crystal is measured, the scanning line driving circuit 130 sets the scanning signal Gd to the H level equivalent to the voltage Vdd.

Figure 6:
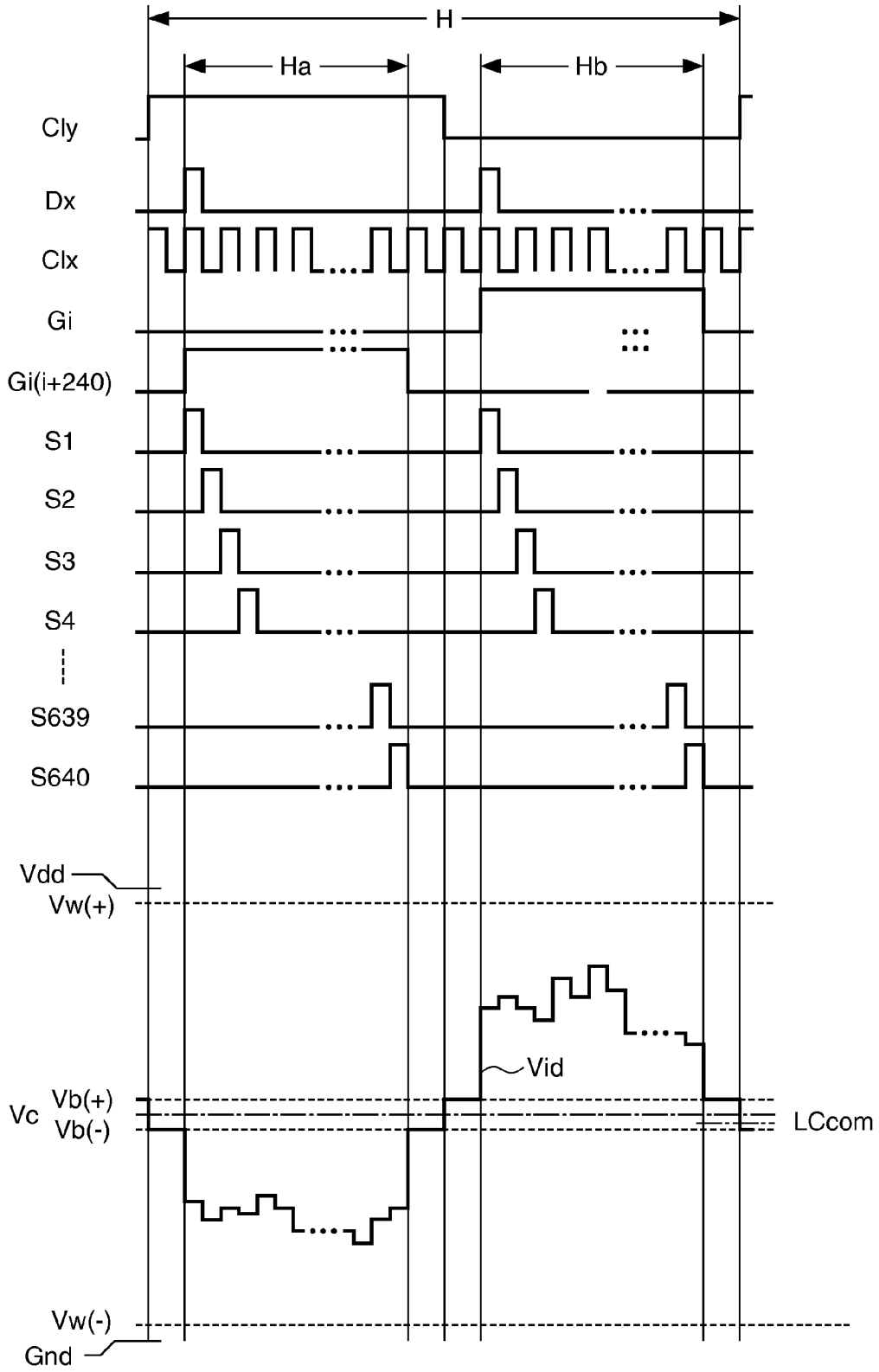
FIG. 6 is a diagram showing a waveform example of a data signal.
Figure 7:
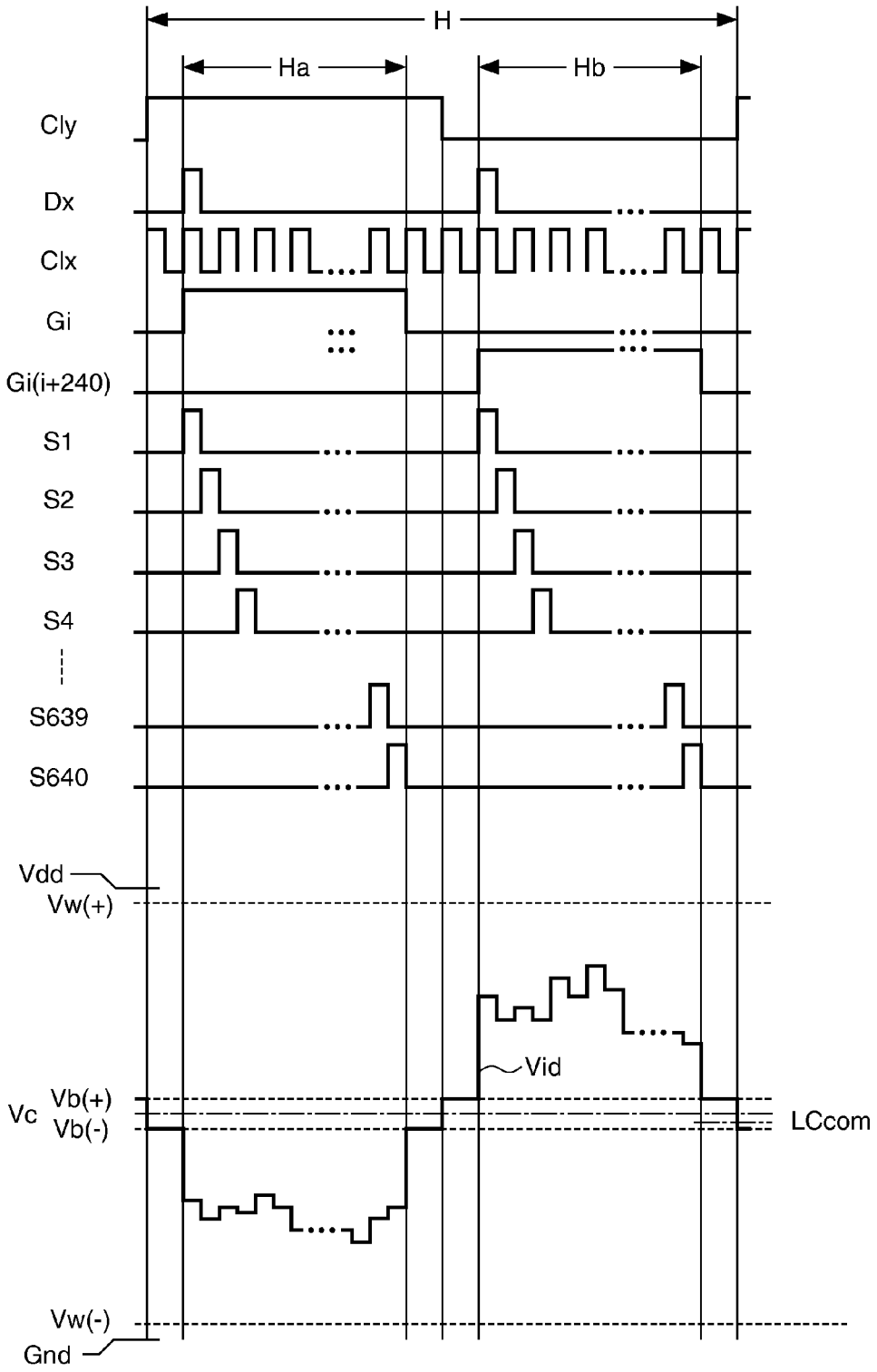
FIG. 7 is a diagram showing a waveform example of the data signal.

The data line driving circuit 140 includes a sampling signal output circuit 142 and thin film transistors (hereinafter referred to as "TFTs") 146 of an n channel type provided to respectively correspond to the data lines 114. The sampling signal output circuit 142 is controlled by the control circuit 50 to output sampling signals S1, S2, S3, . . . , and S640 to respectively correspond to the TFTs 146. As shown in FIGS. 6 and 7, the sampling signal output circuit 142 sequentially shifts, every time the level of a clock signal Clx transitions, a start pulse Dx supplied in a horizontal scanning period (H) and outputs the start pulse Dx as the sampling signals S1, S2, S3, . . . , and S640.

The TFTs 146 are respectively provided in the data lines 114 in the first to 640th columns. The TFTs 146 respectively function as sampling switches. Drain electrodes of the TFTs 146 are connected to one ends of the data lines 114. Source electrodes of the TFTs 146 are connected to an image signal line 148. The sampling signals from the sampling signal output circuit 142 are supplied to gate electrodes of the TFTs 146. For example, the TFT 146 second from the left corresponds to the data line 114 in the second column. Therefore, the sampling signal S2 is supplied to the gate electrode of the TFT 146 corresponding to the data line 114. When the sampling signal S2 changes to the H level, the TFT 146 changes to a conduction (ON) state between the source and drain electrodes. Therefore, the data line 114 is connected to the image signal line 148.

Figure 3:
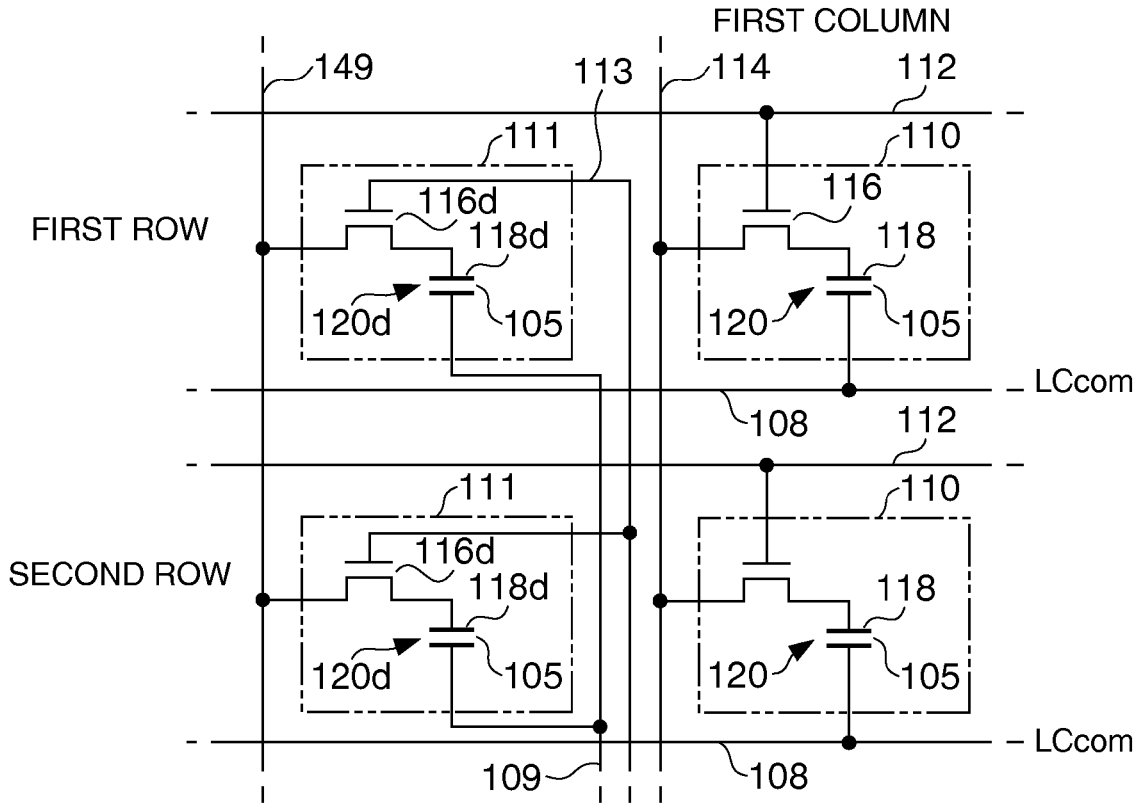
FIG. 3 is a diagram showing the configurations of pixels and dummy pixels.

The pixels 110 and the dummy pixels 111 are explained. FIG. 3 is a diagram showing the configurations of the pixels 110 and the dummy pixels 111. The configurations of the pixel 110 in the first row and the first column, the pixel 110 in the second row and the first column, the dummy pixel 111 adjacent to the pixel 110 in the first row and the first column, and the dummy pixel 111 adjacent to the pixel 110 in the second row and the first column are shown.

The pixels 110 have the same configuration including the TFT 116 of the n channel type and a liquid crystal device 120. In the pixel 110 in an i-th row and a j-th column, the gate electrode of the TFT 116 is connected to the scanning line 112 in the i-th row, the source electrode of the TFT 116 is connected to the data line 114 in the j-th column, and the drain electrode of the TFT 116 is connected to a pixel electrode 118 (a first electrode), which is one end of the liquid crystal device 120. The other end of the liquid crystal device 120 is connected to a first opposed electrode 108 (a first common electrode). The first opposed electrode 108 is common to all the pixels 110. A temporally fixed voltage LCcom is applied to the first opposed electrode 108. "i" is a sign generally indicating a row in which the pixels 110 are arrayed. In this embodiment, "i" is an integer equal to or larger than 1 and equal to or smaller than 480. "j" is a sign generally indicating a column in which the pixels 110 are arrayed. In this embodiment, "j" is an integer equal to or larger than 1 and equal to or smaller than 640. For example, in the pixel 110 in the first row and the first column, the gate electrode of the TFT 116 is connected to the scanning line 112 in the first row, the source electrode of the TFT 116 is connected to the data line 114 in the first column, and the drain electrode of the TFT 116 is connected to the pixel electrode 118, which is one end of the liquid crystal device 120.

The dummy pixels 111 have the same configuration including a TFT 116*d* of the n channel type and a liquid crystal device 120*d*. A gate electrode of the TFT 116*d* is connected to the scanning line 113, a source electrode of the TFT 116*d* is connected to the measuring signal line 149, and a drain electrode of the TFT 116*d* is connected to a pixel electrode 118*d* (a second electrode), which is one end of the liquid crystal device 120*d*. The other end of the liquid crystal device 120*d* is connected to a second opposed electrode 109 (a second common electrode). The second opposed electrode 109 is common to all the dummy pixels 111. The second opposed electrode 109 is connected to a resistance element R of the control circuit 50 by a signal line 107. The second opposed electrode 109 is insulated from the first opposed electrode 108.

Although not specifically shown in the figure, the display panel 100 has a configuration in which a pair of a device substrate and an opposed substrate are stuck together via a fixed gap and liquid crystal is encapsulated in the gap. On the device substrate, the scanning lines 112 and 113, the data lines 114, the TFTs 116, 116*d*, and 146, the pixel electrodes 118 and 118*d*, and the measuring signal line 149 are formed together with the scanning line driving circuit 130 and the data line driving circuit 140. On the other hand, the first opposed electrode 108 and the second opposed electrode 109 are formed on the opposed substrate. Surfaces on which the electrodes are formed are stuck together via a fixed gap to be opposed to each other. The first opposed electrode 108 is opposed to the pixel 110 and the second opposed electrode 109 is opposed to the dummy pixel 111. Therefore, in this embodiment, liquid crystal 105 is held between the pixel electrode 118 and the first opposed electrode 108, whereby the liquid crystal device 120 is formed. The liquid crystal 105 is held between the pixel electrode 118*d* and the second opposed electrode 109, whereby the liquid crystal device 120*d* is formed.

In this embodiment, a normally black mode is set in which, if an effective value of a voltage retained in the liquid crystal device 120 and 120*d* is close to zero (or a value around zero), the transmittance of light passing through the liquid crystal device 120 and 120*d* is minimized and black display is performed and, on the other hand, as the effective value of the retained voltage increase, an amount of light to be transmitted increases and eventually white display with the maximum transmittance is performed.

In this configuration, when a scanning signal is supplied to the scanning line 112, the TFT 116 is turned on (conducted), and the data signal Vid of a voltage corresponding to the gradation (brightness) is supplied to pixel electrode 118 via the data line 114 and the TFT 116 in the ON state, the liquid crystal device 120 corresponding to an intersection of the scanning line 112 to which the scanning signal is supplied and the data line 114 to which the data signal is supplied can be caused to retain an effective voltage corresponding to the gradation. Therefore, the light transmitted through the liquid crystal device 120 can be varied for each of the pixels. Consequently, an image is formed in the display area A1. The formed image is directly viewed by a user or is projected in enlargement on a projector or the like explained later and visually recognized by the user.

In this configuration, when the scanning signal Gd is supplied to the scanning signal 113, the TFT 116*d* is turned on (conducted), and a voltage is applied to the pixel electrode 118*d* via the measuring signal line 149 and the TFT 116*d* in the ON state, the liquid crystal device 120*d* can be caused to retain an effective voltage corresponding to a measuring signal supplied to the measuring signal line 149. In the display panel 100, in order to prevent the dummy pixels 111 from being visually recognized, a light blocking layer that blocks light transmitted through the dummy pixels 111 may be provided further on the outer side than the display area A1.

The control circuit 50 is explained. As shown in FIG. 1, in the control circuit 50, the vertical synchronization signal Vs, the horizontal synchronization signal Hs, and the clock signal Clk are supplied to the scanning control circuit 52 and the image data Vd is supplied to the data signal generating circuit 54.

The image data Vd is supplied from the not-shown external host circuit in synchronization with the vertical scanning signal Vs, the horizontal scanning signal Hs, and the clock signal Clk. The image data Vd is digital data for designating, for example, in 8 bits, the gradation of the pixels 110 in 480 rows×640 columns. Although not specifically shown in the figure, the image data Vd is supplied in the order of the pixels in the first row and the first column to the first row and the 640th column, the second row and the first column to the second row and the 640th column, the third row and the first column to the third row and the 640th column, . . . , and the 480th row and the first column to the 480th row and the 640th column over a vertical scanning period specified by the vertical synchronization signal Vs. When the image data Vd is supplied, the image data Vd for one row is supplied in a horizontal scanning period specified by the horizontal synchronization signal Hs. The image data Vd for one pixel is supplied at one period of the clock signal Clk. The image data Vd for one frame (for all the pixels of the display panel 100) is supplied at a period of 16.7 milliseconds (a frequency of 60 Hz).

The scanning control circuit 52 outputs a polarity designation signal Pol to the data signal generating circuit 54. The polarity designation signal Pol is a signal for designating writing polarity of a voltage in the liquid crystal device 120. For example, positive polarity is designated at the H level and negative polarity is designated at an L level. The positive polarity writing means that the pixel electrode 118 is further on the high-order side than the first opposed electrode 108 when the liquid crystal device 120 is caused to retain a voltage corresponding to gradation. On the other hand, the negative polarity writing means that the pixel electrode 118 is further on the low-order side than the first opposed electrode 108.

The data signal generating circuit 54 once stores the image data Vd supplied from an external host device in an internal memory (not shown in the figure) and then reads out the image data Vd in synchronization with the driving of the display panel 100. When the data signal generating circuit 54 selects a scanning line in a certain row of the display panel 100, the data signal generating circuit 54 reads out the image data Vd in the relevant row, converts the read-out image data Vd into an analog signal, and generates the data signal Vid.

When the positive polarity writing is designated by the polarity designation signal Pol, the data signal generating circuit 54 sets the data signal Vid to a voltage on the high-order side with respect to a reference voltage Vc (a reference voltage), which is set slightly further on the high-order side than the applied voltage LCcom to the first opposed electrode 108, and corresponding to gradation. When the negative polarity writing is designated by the polarity designation signal Pol, the data signal generating circuit 54 sets the data signal Vid to a voltage on the low-order side with respect to the reference voltage Vc and corresponding to gradation. The polarity is switched in order to prevent the liquid crystal from being deteriorated by the application of a direct-current component.

Figure 4A:
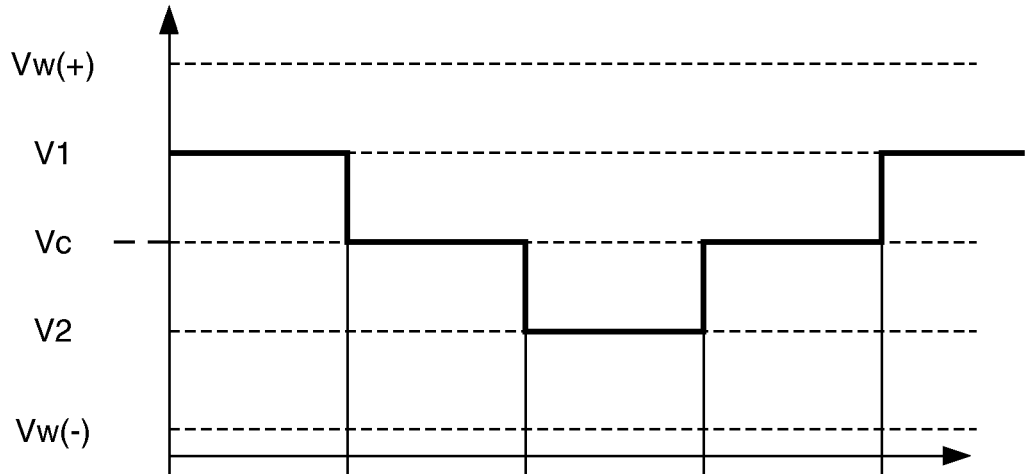
FIGS. 4A to 4C are diagrams showing changes in a waveform of a measuring signal Me, a waveform of a voltage measured by a detection circuit, and the transmittance of liquid crystal.

The scanning control circuit 52 outputs a measuring signal Me and a voltage setting signal Vset. The measuring signal Me is a signal output for measuring an electric current flowing to the liquid crystal of the dummy pixel 111. The measuring signal Me is supplied to the measuring signal line 149. As shown in FIG. 4A, the voltage of the measuring signal Me repeatedly changes in the order of the reference voltage Vc (a third voltage), a voltage V1 (a first voltage) on the high-order side with respect to the reference voltage Vc, and a voltage V2 (a second voltage) on the low-order side with respect to the reference voltage Vc.

The voltage setting signal Vset is a signal for specifying the potential of the second opposed electrode 109. The voltage setting signal Vset is supplied to the second opposed electrode 109. When the voltage setting signal Vset is supplied to the second opposed electrode 109, the reference voltage Vc is applied to the second opposed electrode 109.

The scanning control circuit 52 outputs start pulses Dx, Dya, and Dyb and clock signals Clx and Cly in synchronization with the vertical synchronization signal Vs, the horizontal synchronization signal Hs, and the clock signal Clk.

Specifically, the scanning control circuit 52 outputs the start pulses Dya and Dyb and the clock signal Cly such that the scanning line 112 in the first row is selected in a horizontal scanning period in which the data signal Vid corresponding to the image data Vd in the first row is supplied. The scanning control circuit 52 outputs the clock signal Cly such that the scanning lines 112 in the second, third, fourth, . . . , and 480th row are selected in horizontal scanning periods in which the data signals Vid corresponding to the image data Vd in the second, third, fourth, . . . , and 480th rows are supplied. In this way, the scanning control circuit 52 controls the scanning line driving circuit 130.

When the data signal Vid corresponding to the pixels in the first column is output, the scanning control circuit 52 sets the sampling signal S1 to the H level. When the data signals Vid corresponding to the pixels in the second, third, . . . , and 640th columns are output, the scanning control circuit 52 outputs the start pulse Dx and the clock signal Clx to set the sampling signals S2, S3, . . . , and S640 to the H level. In this way, the scanning control circuit 52 controls the sampling signal output circuit 142.

Figure 5:
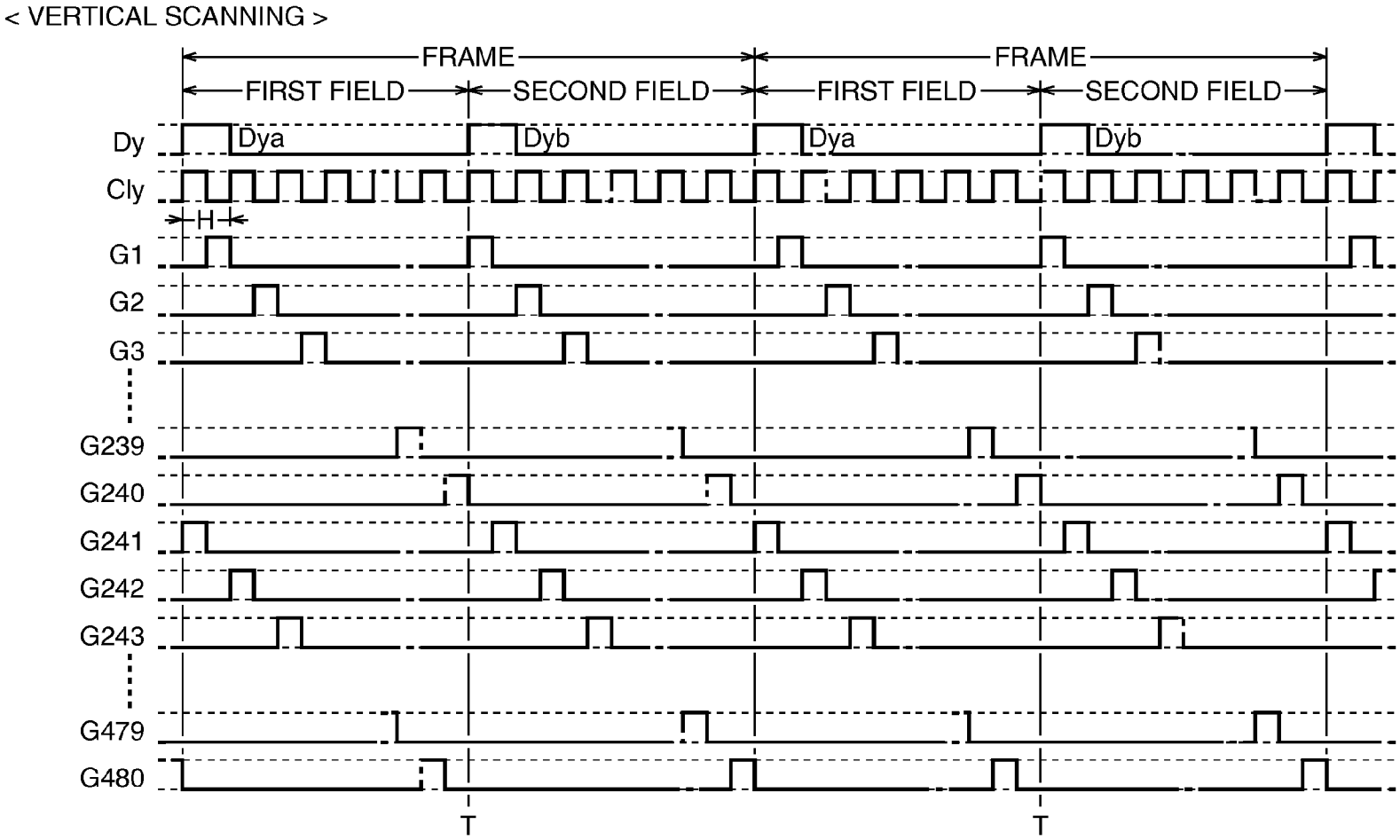
FIG. 5 is a diagram showing the operation of a scanning line driving circuit.

FIG. 5 is a timing chart showing, in a relation with the start pulses Dya and Dyb and the clock signal Cly, the scanning signals G1 to G480 output by the scanning line driving circuit 130. As shown in the figure, in this embodiment, the scanning lines 112 are respectively selected twice in a period of one frame. The frame means a period required for causing the display panel 100 to display one image. However, since the image data Vd is supplied at the period of 16.7 milliseconds (the frequency of 60 Hz), one frame coincides with the 16.7 milliseconds of the period.

The scanning control circuit 52 outputs the clock signal Cly with a duty ratio of 50% over the period of one frame by 480 periods equal to the number of scanning lines. In FIG. 5, a period of one period of the clock signal Cly is represented as H. The scanning control circuit 52 outputs the start pulses Dya and Dyb, which have pulse width for one period of the clock signal Cly, respectively as explained below during rising of the clock signal Cly to the H level. The scanning control circuit 52 outputs the start pulse Dya in the beginning of the period of one frame (i.e., in the beginning of a first field). On the other hand, the scanning control circuit 52 outputs the start pulse Dyb at timing T when 240 periods of the clock signal Cly are output (i.e., a half period of one frame elapses) after the start pulse Dyb is output. However, in some case, as explained later, the scanning control circuit 52 outputs the start pulse Dyb temporally earlier or later by a unit of the period of the clock signal Cly with respect to the timing T.

In this embodiment, in the period of one frame, a period from the output of the start pulse Dya to the output of the start pulse Dyb is set as a first field. A period from the output of the start pulse Dyb to the output of the next start pulse Dya is set as a second field. The start pulses Dya and Dyb are alternately output. The start pulse Dya is output at start timing of one frame, i.e., at every 16.7 milliseconds. Therefore, when the start pulse Dya is specified, the start pulse Dyb can be necessarily specified. Therefore, in FIG. 1, FIG. 2, and the like, the start pulse Dya and the start pulse Dyb are represented as start pulse Dy without specifically distinguishing the start pulses.

The scanning line driving circuit 130 outputs the scanning signals G1 to G480 shown in FIG. 5 from the start pulses Dya and Dyb and the clock signal Cly. Specifically, when the start pulse Dya is supplied, the scanning line driving circuit 130 sequentially sets the scanning signals G1 to G480 to the H level in a period in which the clock signal Cly is at the L level. On the other hand, when the start pulse Dyb is supplied, the scanning line driving circuit 130 sequentially sets the scanning signals G1 to G480 to the H level in a period in which the clock signal Cly is at the H level.

Therefore, according to the supply of the start pulse Dya, the scanning lines 112 are selected at a period of a half period of the clock signal Cly in the order of the first, second, third, fourth, . . . , and 480th rows downward on a screen from the first field to the second field of a certain frame. On the other hand, according to the supply of the start pulse Dyb, the scanning lines 112 are selected in the intervals of selection triggered by the supply of the start pulse Dya in the order of the first, second, third, fourth, . . . , and 480th rows downward on the screen from the second field of the certain frame to the first field of the next frame. A period in which the scanning signal is at the H level is actually set shorter than the period of the half period of the clock signal Cly as shown in FIGS. 5 and 6.

Output timing of the start pulse Dyb is explained. The scanning control circuit 52 controls the output timing of the start pulse Dyb. Specifically, as a setting value for designating the output timing of the start pulse Dyb, the scanning control circuit 52 stores a first setting value and a predetermined second setting value. In this embodiment, the first setting value is a minus integer value and the second setting value is a plus integer value. The scanning control circuit 52 includes a register that stores a value for designating the output timing of the start pulse Dyb. The scanning control circuit 52 changes the output timing of the start pulse Dyb according to the value stored in the register.

Specifically, first, the scanning control circuit 52 stores the image data Vd supplied from the external host device in the internal memory of the data signal generating circuit 54 and then, in selecting the scanning line 112 in a certain row in the display panel 100, reads out the image data Vd in the relevant row at double speed of storage speed. At the same time, the scanning control circuit 52 controls the sampling signal output circuit 142 according to the readout of the image data Vd such that the sampling signals S1 to S640 change to the H level in order. The read-out image data Vd is converted into the analog data signal Vid.

When the value stored in the register is "0", the scanning control circuit 52 supplies the start pulse Dyb at the timing T. When the scanning control circuit 52 supplies the start pulse Dyb at the timing T, in the first field, the scanning lines 112 are selected in the order of the 241st, first, 242nd, second, 243rd, third, . . . , 480th, and 240th rows.

Therefore, the scanning control circuit 52 controls the scanning line driving circuit 130 such that the scanning line 112 in the 241st row is selected first. The scanning control circuit 52 controls the data signal generating circuit 54 to read out, at the double speed, the image data Vd corresponding to the 241st row stored in the memory and convert the image data Vd into the data signal Vid having the negative polarity according to the polarity designation signal Pol. At the same time, the scanning control circuit 52 controls, according to the readout, the sampling signal output circuit 142 such that the sampling signals S1 to S640 exclusively change to the H level in this order. When the sampling signals S1 to S640 changes to the H level in order, the TFTs 146 are sequentially turned on from the first column to the 640th column. The data signal Vid supplied to the image signal line 148 is sampled in order in the data lines 114 in the first to 640th columns.

On the other hand, when the scanning line 112 in the 241st row is selected and the scanning signal G241 changes to the H level, all the TFTs 116 in the pixels 110 located in the 241st row are turned on. Therefore, a negative voltage of the data signal Vid sampled in the data lines 114 is directly applied to the pixel electrode 118. Therefore, in the liquid crystal devices 120 in the pixels in the 241st row and the first, second, third, fourth, . . . , 639th, and 640th columns, a negative voltage corresponding to gradation designated by the image data Vd is written and retained.

Subsequently, the scanning control circuit 52 controls the scanning line driving circuit 130 such that the scanning line 112 in the first row is selected. The scanning control circuit 52 controls the data signal generating circuit 54 to read out, at the double speed, the image data Vd corresponding to the first row stored in the memory and convert the image data Vd into the data signal Vid having the positive polarity according to the polarity designation signal Pol. At the same time, the scanning control circuit 52 controls, according to the readout, the sampling signal output circuit 142 such that the sampling signals S1 to S640 exclusively change to the H level in this order.

When the scanning line 112 in the first row is selected and the scanning signal G1 changes to the H level, all the TFTs 116 in the pixels 110 located in the first row are turned on. Consequently, the voltage of the data signal Vid sampled in the data lines 114 is applied to the pixel electrode 118. Therefore, in the liquid crystal devices 120 in the pixels in the first row and the first to 640th columns, a positive voltage corresponding to gradation designated by the image data Vd is written and retained.

Thereafter, in the first field, the same voltage writing operation is executed in the order of the 242nd, second, 243rd, third, . . . , 480th, and 240th rows. Consequently, a positive voltage corresponding to gradation is written in the pixels in the first to 240th rows and a negative voltage corresponding to gradation is written in the pixels in the 241st to 480th rows. The positive voltage and the negative voltage are retained.

When the start pulse Dyb is supplied at the timing T, in the second field, the scanning lines 112 are selected in the order of the first, 241st, second, 242nd, third, 243rd, fourth, 244th, . . . , 240th, and 480th rows. Writing polarity in the same row is reversed. Therefore, a negative voltage corresponding to gradation is written in the pixels in the first to 240th rows and a positive voltage corresponding to gradation is written in the pixels in the 241st to 480th rows. The negative voltage and the positive voltage are retained.

In FIG. 6, an example of a voltage waveform of the data signal Vid in a period in which a scanning line in a (i+240)th row and a scanning line in an i-th row in the first field are selected is shown. In the figure, voltages Vw(+) and Vw(−) are positive and negative voltages corresponding to a white color having maximum gradation and are in a symmetrical relation with respect to the reference voltage Vc. The reference voltage Vc is an amplitude center of the data signal Vid and is a voltage in the middle of the voltages Vw(+) and Vw(−). In this embodiment, unless specifically explained, the ground potential Gnd is set as a reference of a voltage. It is assumed that a black color having minimum gradation is designated when a decimal value of a gradation value designated by the image data Vd is "0" and, thereafter, brighter gradation is designated according to an increase in the decimal value. In this case, since the normally black mode is set in this embodiment, if the voltage of the data signal Vid is converted into the positive polarity, the voltage changes from the reference voltage Vc to a voltage biased to the high-order side (the Vw(+) side) as the gradation value increases. If the voltage of the data signal Vid is converted into the negative polarity, the voltage changes from the reference voltage Vc to a voltage biased to the low-order side (the Vw(−) side) as the gradation value increases.

In the first field, the scanning line in the (i+240)th row is selected earlier than the scanning line in the i-th row. Therefore, for example, in a period in which the sampling signal S1 changes to the H level in a period in which a scanning signal G(i+240) changes to the H level, the data signal Vid changes to a negative voltage corresponding to the gradation of the pixels in the (i+240)th row and the first column. Thereafter, the data signal Vid changes to a negative voltage corresponding to the gradation of the pixels in the second, third, fourth, . . . , and 640th columns according to the change in the sampling signal. In the i-th row selected following the (i+240) th row, the positive polarity writing is designated. Therefore, in a period in which the sampling signal S1 changes to the H level in a period in which a scanning signal Gi changes to the H level, the data signal Vid changes to a positive voltage corresponding to the gradation of the pixels in the i-th row and the first column. Thereafter, the data signal Vid changes to a positive voltage corresponding to the gradation of the pixels in the second, third, fourth, . . . , and 640th columns according to the change in the sampling signal. In the second field, the scanning line in the (i+240)th row is selected later than the scanning line in the i-th row. Therefore, since the scanning signal Gi changes to the H level first and the writing polarity is reversed, a voltage waveform of the data signal Vid is as shown in FIG. 7.

A longitudinal scale indicating the voltage of the data signal Vid in FIGS. 6 and 7 is set larger than a longitudinal scale in other signals for convenience. The data signal Vid have a voltage corresponding to the black color over a period from the change of the sampling signal S640 to the L level to the change of the sampling signal S1 to the H level. This is for the purpose of preventing, even if the data signal Vid is written in the pixels by mistake because of a timing shift or the like, the data signal Vid from contributing to display.

Figure 8:
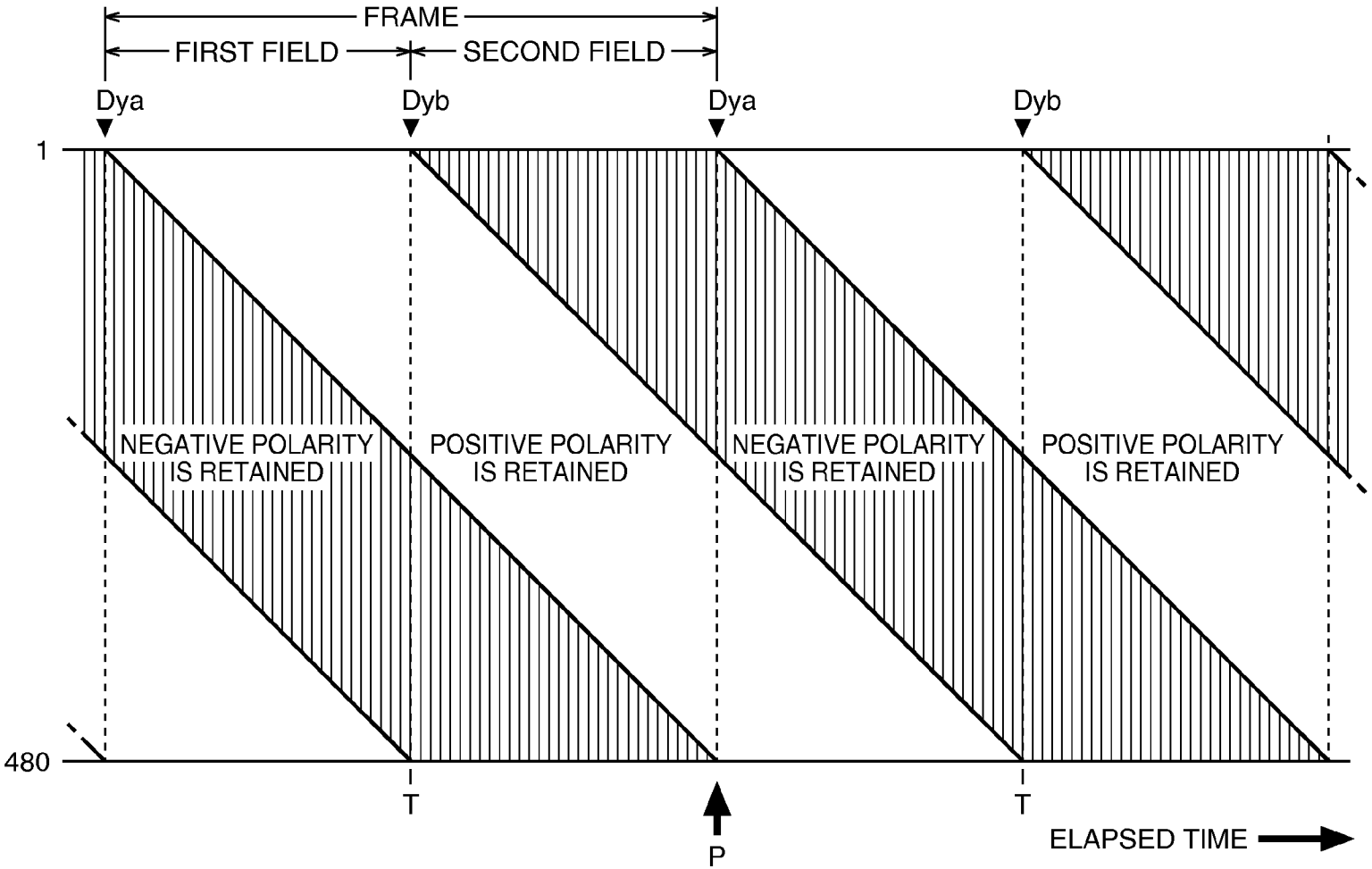
FIG. 8 is a diagram showing transition of writing of pixels in a display area.

FIG. 8 is a diagram showing writing states in the respective rows according to the elapse of time over continuous frames when the start pulse Dyb is supplied at the timing T. As shown in the figure, in this embodiment, in the first field, the negative polarity writing is performed in the pixels in the 241st, 242nd, 243rd, . . . , and 480th rows, the positive polarity writing is performed in the pixels in the first, second, third, . . . , and 240th rows, and written voltages are retained until the next writing. On the other hand, in the second field, the negative polarity writing is performed in the pixels in the first, second, third, . . . , and 240th rows, the positive polarity writing is performed in the pixels in the 241st, 242nd, 243rd, . . . , and 480th rows, and written voltages are also retained until the next writing.

When a value of the register is "0" and the start pulse Dyb is supplied at the timing T, since the periods of the first and second fields are equivalent to 240 periods of the clock signal Cly, a period in which the positive voltage is retained in the liquid crystal devices 120 in the pixels and a period in which the negative voltage is retained in the liquid crystal devices 120 are equal halves.

Figure 9:
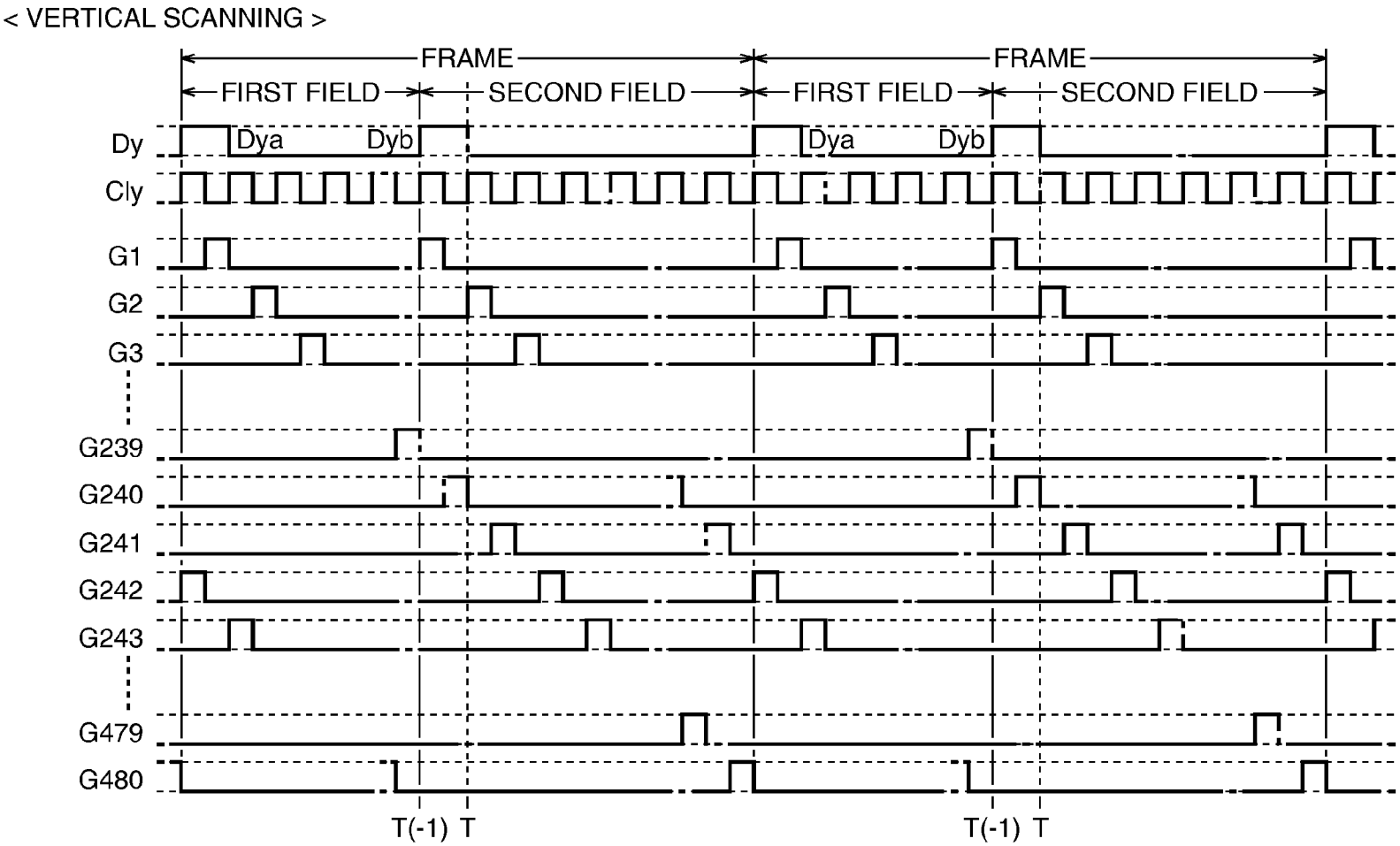
FIG. 9 is a diagram showing the operation of the scanning line driving circuit.
Figure 10:
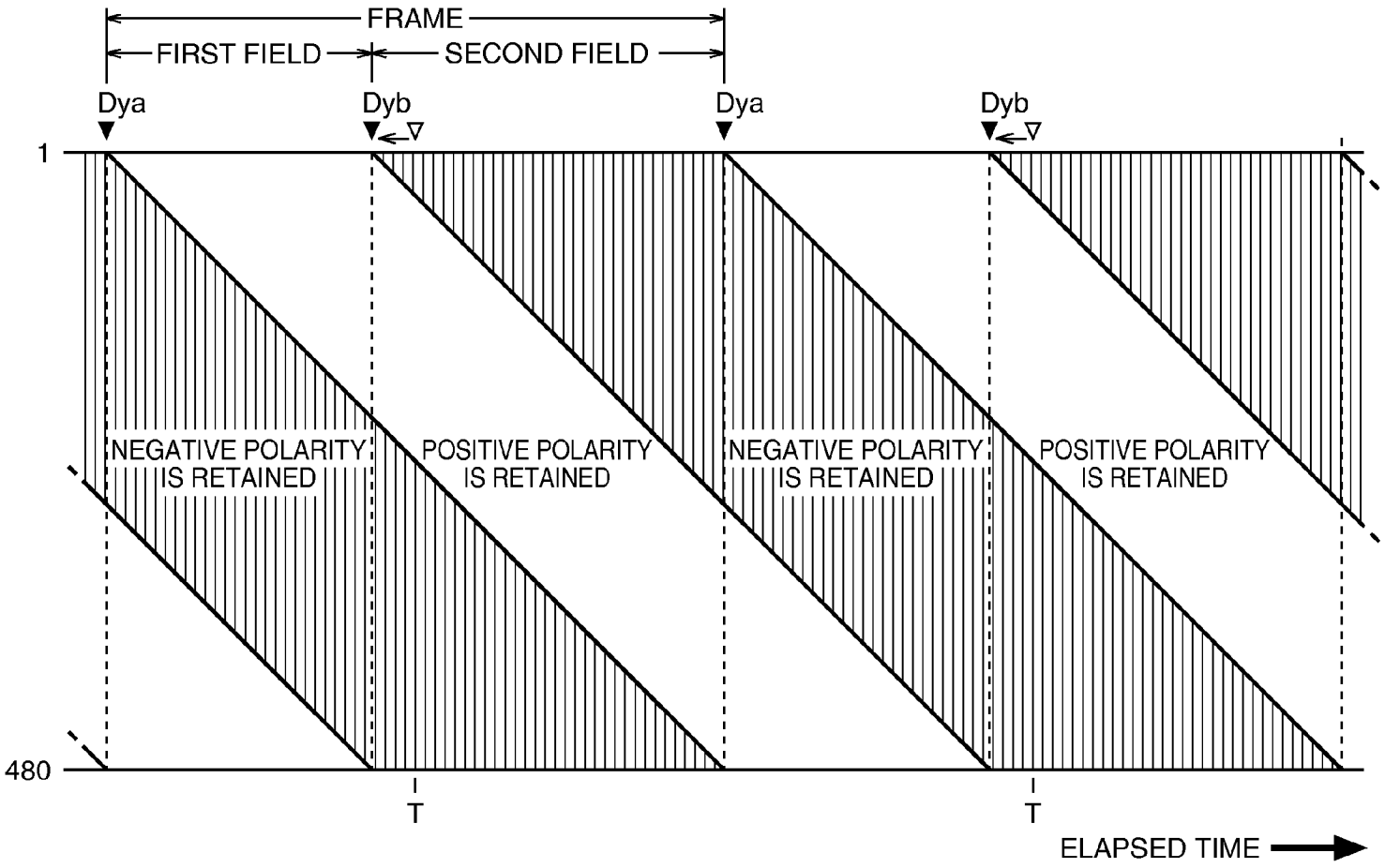
FIG. 10 is a diagram showing transition of writing of the pixels in the display area.

When the value stored in the register is a value other than 0, for example, when the value stored in the register is "−1", as shown in FIG. 9, the scanning control circuit 52 changes the start pulse Dyb to timing T(−1) earlier than the timing T by one period of the clock signal Cly and outputs the start pulse Dyb. Then, while the period of the first field is equivalent to 239 periods of the clock signal Cly, the period of the second field is equivalent to 241 periods of the clock signal Cly. Consequently, as shown in FIG. 10, a retaining period of the negative voltage written by the selection triggered by the supply of the start pulse Dyb is longer than a retaining period of the positive voltage written by the selection triggered by the supply of the start pulse Dya. Therefore, in the pixels, an effective voltage retained at the negative voltage is raised and an effective voltage retained at the positive voltage is lowered.

When the effective voltage retained at the negative voltage is higher than the effective voltage retained at the positive voltage, the pixels change in a direction in which the pixels brighten when the negative voltage is retained and darken when the positive voltage is retained. If the value stored in the register is "−2", the scanning control circuit 52 changes the start pulse Dyb to timing earlier than the timing T by two periods of the clock signal Cly and outputs the start pulse Dyb. Then, in the pixels, the effective voltage retained at the negative voltage is further raised and the effective voltage retained at the positive voltage is further lowered than the effective voltages raised and lowered when the value stored in the register is "−1".

Figure 11:
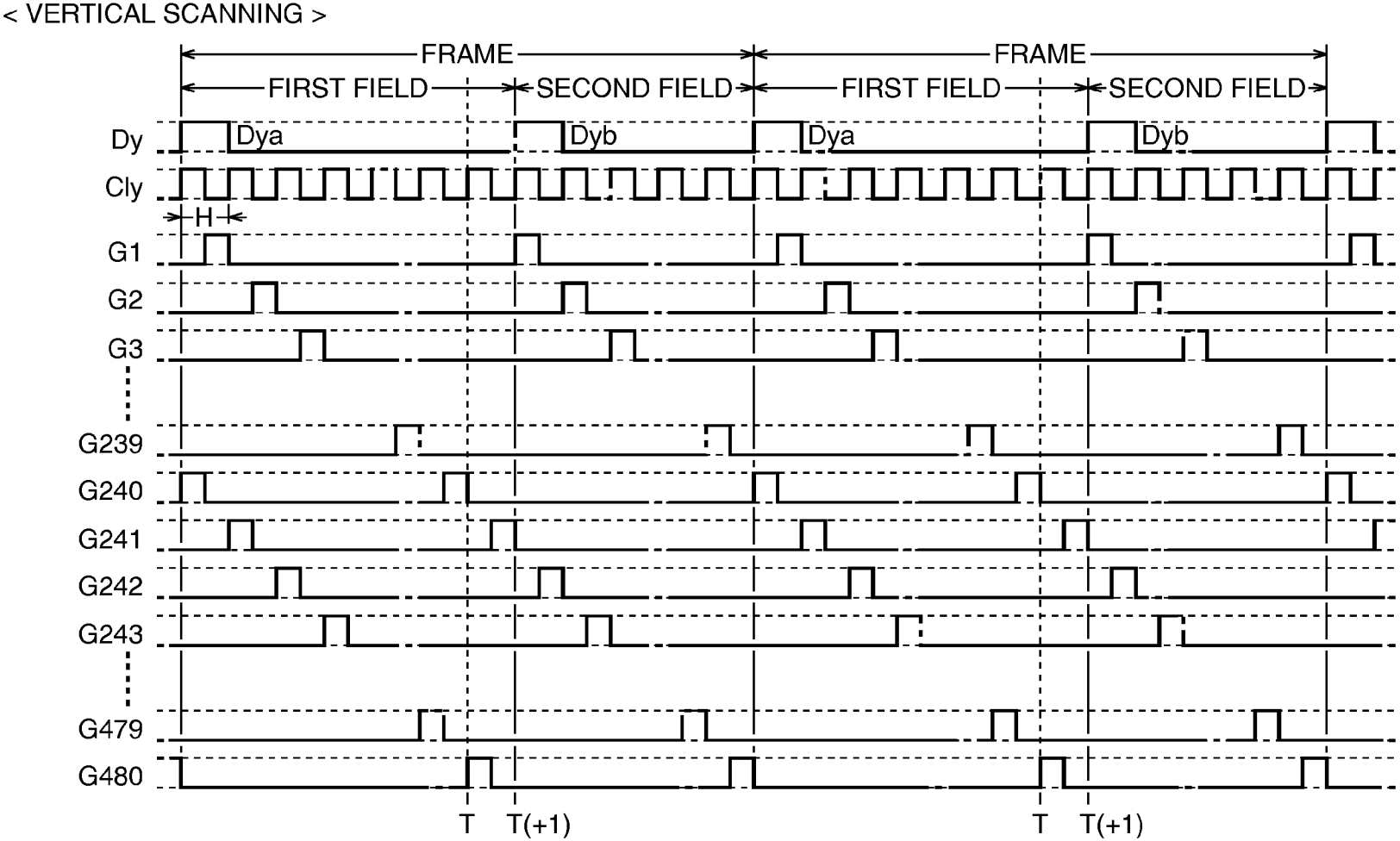
FIG. 11 is a diagram showing the operation of the scanning line driving circuit.
Figure 12:
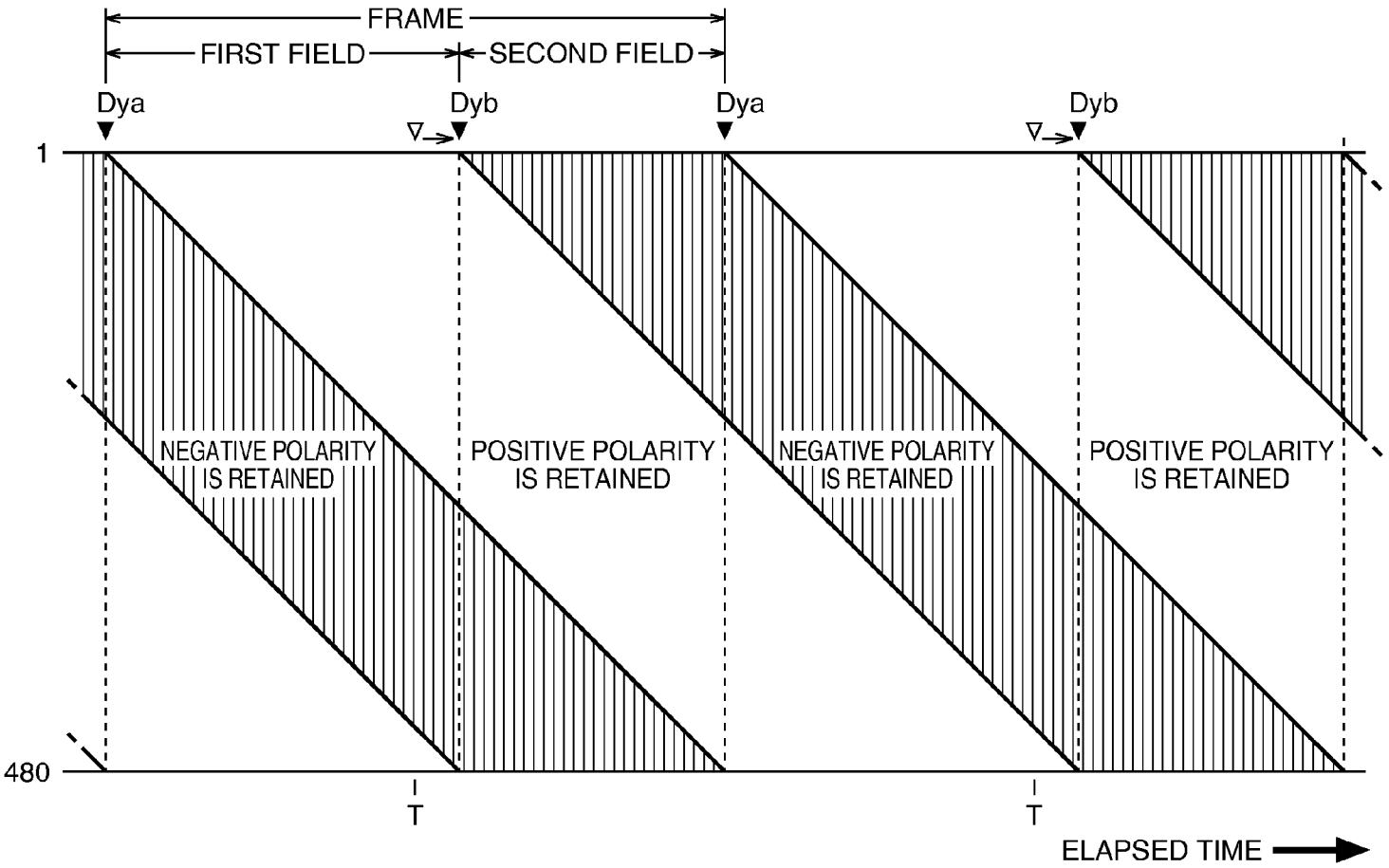
FIG. 12 is a diagram showing transition of writing of the pixels in the display area.

On the other hand, when the value stored in the register is "+1", as shown in FIG. 11, the scanning control circuit 52 changes the start pulse Dyb to timing T(+1) later than the timing T by one period of the clock signal Cly and outputs the start pulse Dyb. Then, whereas the period of the first field is equivalent to 241 periods of the clock signal Cly, the period of the second field is equivalent to 239 periods of the clock signal Cly. Consequently, as shown in FIG. 12, the retaining period of the negative voltage written by the selection triggered by the supply of the start pulse Dyb is shorter than the retaining period of the positive voltage written by the selection triggered by the supply of the start pulse Dya. Therefore, in the pixels, the effective voltage retained at the positive voltage is raised and the effective voltage retained at the negative voltage is lowered.

When the effective voltage retained at the positive voltage is higher than the effective voltage retained at the negative voltage, the pixels change in a direction in which the pixels brighten when the positive voltage is retained and darken when the negative voltage is retained. If the value stored in the register is "+2", the scanning control circuit 52 changes the start pulse Dyb to timing later than the timing T by two periods of the clock signal Cly and outputs the start pulse Dyb. Then, in the pixels, the effective voltage retained at the positive voltage is further raised and the effective voltage retained at the negative voltage is further lowered than the effective voltages raised and lowered when the value stored in the register is "+1".

The scanning control circuit 52 changes the value of the register in this way, whereby a ratio of the effective voltage retained at the positive voltage and the effective voltage retained at the negative voltage is changed. Therefore, the scanning control circuit 52 functions as an effective voltage changing circuit that changes the ratio of the effective voltage retained at the positive voltage and the effective voltage retained at the negative voltage.

As shown in FIG. 6, the voltage LCcom applied to the first opposed electrode 108 is set further on the low-order side than the reference voltage Vc during the shipment from a factory. This is because, in an electro-optical device of an active matrix type in which pixel electrodes are driven by TFTs, so-called push-down occurs and leakage of liquid crystal devices is different when the positive voltage is applied and when the negative voltage is applied. If the voltage LCcom is set equal to the reference voltage Vc, the effective voltage of the liquid crystal devices 120 by the negative polarity writing is slightly larger than the effective voltage by the positive polarity writing (when the TFTs 116 are n channels). Therefore, the voltage LCcom is set to be offset further to the low-order side than the reference voltage Vc to be an optimum value for offsetting a difference between the effective voltages.

In this embodiment, when the start pulse Dyb is supplied at the timing T, the periods of the first and second fields are equal to each other and the retaining periods of the positive voltage and the negative voltage written in the liquid crystal devices 120 are the same in the pixels. Therefore, a direct-current component should not be applied to the liquid crystal devices 120. However, when a push-down amount of the TFTs and a leak amount in the liquid crystal devices change from those during the shipment from a factory because of aged deterioration or the like, the voltage LCcom is not the optimum value anymore and a direct-current component is applied to the liquid crystal devices 120. Then, a difference occurs in the brightness of the pixels 110 between the period in which the positive voltage is retained and the period in which the negative voltage is retained.

As the display panel 100, there are panels respectively having different characteristics. The panels include a panel having characteristics that it is necessary to increase the voltage LCcom in order to reduce the difference in the brightness of the pixels 110 between the period in which the positive voltage is retained and the period in which the negative voltage is retained and a panel having characteristics that it is necessary to reduce the voltage LCcom in order to reduce the difference in the brightness of the pixels 110. In this case, even if the value of the register is set to 0, the difference in the brightness occurs in the pixels 110.

Figure 13:
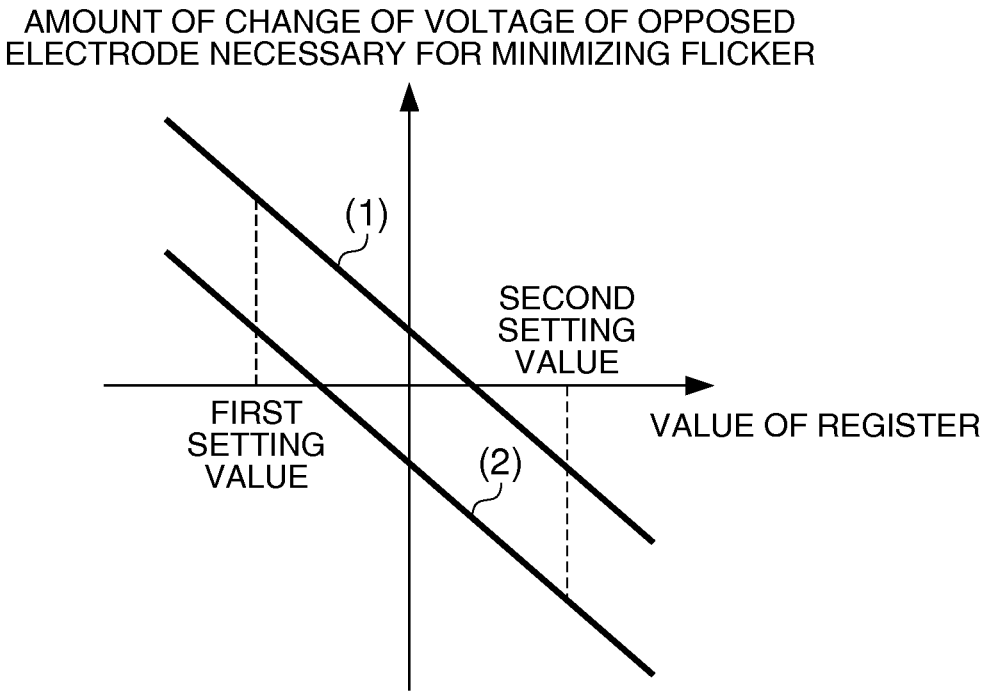
FIG. 13 is a diagram showing characteristics of the display panel.

FIG. 13 is a diagram for explaining the characteristics of the display panel 100. In the figure, the abscissa represents the value of the register. The abscissa indicates that, when the value of the register is positive, the retaining period of the positive voltage is long and, when the value of the register is negative, the retaining period of the negative voltage is long. The ordinate represents, after a fixed time elapses, by which degree the voltage of the first opposed electrode 108 should be changed from the voltage LCcom to minimize a flicker.

A panel having characteristics (1) in FIG. 13 is a panel having characteristics that, when time elapses when the value of the register is 0, a direct-current component is applied to the liquid crystal devices 120 and it is necessary to set the voltage applied to the first opposed electrode 108 to be larger than the voltage LCcom in order to minimize a flicker. A panel having characteristics (2) in FIG. 13 is a panel having characteristics that, when time elapses when the value of the register is 0, a direct-current component is applied to the liquid crystal device 120 and it is necessary to set the voltage applied to the first opposed electrode 108 to be smaller than the voltage LCcom in order to minimize a flicker.

The second setting value, which is a setting value for designating the output timing of the start pulse Dyb, is a second setting value shown in FIG. 13 and is a value that causes necessity for reducing the voltage LCcom in order to minimize a flicker after the elapse of the fixed time for both the panel having the characteristics (1) and the panel having the characteristics (2) in FIG. 13. The first setting value, which is a setting value for designating the output timing of the start pulse Dyb, is a first setting value shown in FIG. 13 and is a value that causes necessity for increasing the voltage LCcom in order to minimize a flicker after the elapse of the fixed time for both the panel having the characteristics (1) and the panel having the characteristics (2) in FIG. 13.

During the shipment of an electronic apparatus including the electro-optical device 1, the value of the register is set to 0 (i.e., the retaining time of the positive voltage and the regaining time of the negative voltage are set the same) and the voltage of the first opposed electrode 108 is adjusted to the voltage LCcom to prevent a flicker from being sensed. However, when a direct-current component is applied to the liquid crystal devices 120 because of aged deterioration, the difference in the effective voltages increases between the retaining period of the positive voltage and the retaining period of the negative voltage and a flicker is sensed.

In the case of the panel having the characteristics (1) in FIG. 13, when time elapses and a direct-current component is applied to the liquid crystal devices 120, an optimum voltage of the first opposed electrode 108 for minimizing a flicker is larger than the voltage LCcom.

On the other hand, in the case of the panel having the characteristics (2) in FIG. 13, when time elapses and a direct-current component is applied to the liquid crystal devices 120, the optimum voltage of the first opposed electrode 108 for minimizing a flicker is smaller than the voltage LCcom.

When the display panel 100 is driven, unless a direct-current component is applied to the liquid crystal display devices 120 in a state in which the value of the register is set to 0 and the retaining period of the positive voltage and the retaining period of the negative voltage are set the same, a flicker and burn-in do not occur. However, the characteristics of the display panel 100 have fluctuation. When the display panel 100 continues to be driven, a direct-current component is applied to the liquid crystal devices 120 and a difference occurs in the effective voltages between the retaining period of the positive voltage and the retaining period of the negative voltage. When the difference increases, a flicker occurs. When a state in which the difference is large continues, burn-in occurs.

The occurrence of a flicker means that the transmittance of the liquid crystal devices is different between a state in which the positive voltage is retained and a state in which a negative voltage is regained. This means that the capacity of the liquid crystal devices is different as explained at the beginning of this specification. Therefore, if the liquid crystal devices 120 are controlled to reduce the difference in the capacity between the regaining period of the positive voltage and the retaining period of the negative voltage, the difference decreases between the effective voltage retained at the positive voltage and the effective voltage retained at the negative voltage and a flicker and burn-in do not occur.

To perform this control, it is necessary to measure the capacity of the liquid crystal devices 120. However, since it is difficult to directly detect the capacity of liquid crystal devices, in this embodiment, an electric current flowing to the liquid crystal devices to correspond to the capacity of the liquid crystal devices is measured and an applied voltage to the liquid crystal devices is controlled on the basis of the measured electric current. A configuration for performing this control is explained below.

The resistance element R, the detection circuit 61, and the A/D conversion circuit 56 shown in FIG. 1 are components for measuring an electric current flowing to the liquid crystal device 120*d*. One end of the resistance element R is connected to the scanning control circuit 52 and the other end of the resistance element R is connected to the signal line 107. Therefore, a voltage proportional to an electric current flowing to the second opposed electrode 109 appears at both the ends of the resistance element R. The detection circuit 61 detects the voltage at both the ends of the resistance element R and amplifies the voltage. The A/D conversion circuit 56 converts the voltage detected and amplified by the detection circuit 61 into digital data and outputs the digital data to the scanning control circuit 52. A sampling rate (a sampling frequency) by the A/D conversion circuit 56 is set sufficiently high with respect to a change in the voltage detected and amplified by the detection circuit 61. If the voltage indicated by the digital data is divided by the resistance of the resistance element R and a voltage amplification ratio by the detection circuit 61, a value of an electric current flowing to the second opposed electrode 109 can be calculated.

In order to measure the electric current flowing to the liquid crystal device, the scanning line driving circuit 130 always sets the scanning signal Gd supplied to the scanning line 113 to the H level. Consequently, the TFT 116*d* of the dummy electrode 111 is always on. The scanning line driving circuit 130 applies the reference voltage Vc to the signal line 107 via the resistance element R. The scanning control circuit 52 supplies the measuring signal Me shown in FIG. 4A to the measuring signal line 149.

The voltage of the measuring signal Me is switched in the order of the voltage V1, the reference voltage Vc, the voltage V2, and the reference voltage Vc. The switching of the voltage is repeated. The voltage V1 is a positive voltage between the voltage Vw(+) and the reference voltage Vc. The voltage V2 is a negative voltage between the voltage Vw(−) and the reference voltage Vc. If the switching of the voltage is fast in the measuring signal Me, it is difficult to measure an electric current. Therefore, the frequency of the measuring signal Me is desirably a frequency (e.g., 10 Hz to 20 Hz) lower than the frequency of one frame. In other words, a period in which the voltage V1 (the first voltage) of the measuring signal Me is applied to the pixel electrode 118*d* (the second electrode) is desirably longer than a period in which the positive voltage is applied to the pixel electrode 118 (the first electrode). A period in which the voltage V2 (the second voltage) of the measuring signal Me is applied to the pixel electrode 118*d*

(the second electrode) is desirably longer than a period in which the negative voltage is applied to the pixel electrode 118 (the first electrode).

In the display device 100, since the TFTs 116*d* of all the dummy pixels 111 are in the ON state, the measuring signal Me is supplied to all the pixel electrodes 118*d*. Since the voltage of the measuring signal Me is switched as shown in FIG. 4A, electric currents flow to the liquid crystal devices 120*d* according to the switching of the voltage. At this point, an electric current obtained by summing up electric currents respectively flowing to the liquid crystal devices 120*d* flows to the signal line 107 to which the second opposed electrode 109 and the resistance element R are connected. The sum electric current flowing to the signal line 107 is converted into a voltage by the resistance element R. The voltage is measured by the scanning control circuit 52. A voltage waveform (a current waveform) measured at this point is considered to be a voltage waveform shown in FIG. 4B. A reason for this is explained below in detail.

First, when a voltage applied to the pixel electrode 118*d* is switched from the reference voltage Vc to the voltage V1, an applied voltage to the liquid crystal device 120*d* (a difference between a voltage applied to the pixel electrode and a voltage applied to the second opposed electrode 109) instantaneously changes with respect to the switching. However, as shown in FIG. 4C, transmittance, which is an optical response, changes rather slowly with respect to the change in the driving voltage. In other words, the transmittance changes in an integral manner from transmittance Tb corresponding to the black color to transmittance Tg corresponding to intermediate gradation. The capacity of the liquid crystal device 120*d* changes according to a molecule array state (tilt) of liquid crystal, which is a dielectric, interposed between the pixel electrode 118*d* and the second opposed electrode 109. The transmittance is determined according to the tilt. Therefore, the capacity of the liquid crystal device 120*d* is considered to change according to a characteristic substantially the same as the transmittance.

Figure 4B:
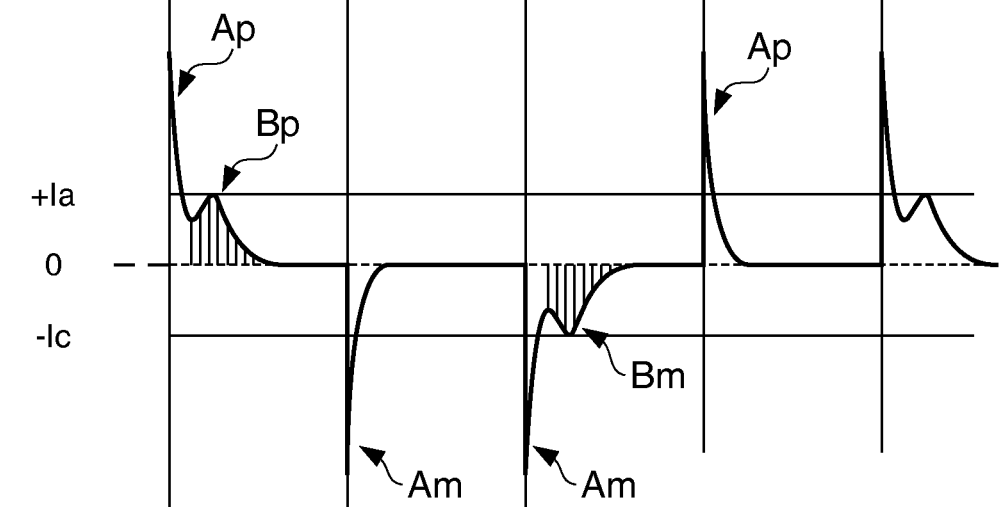
Figure 4C:
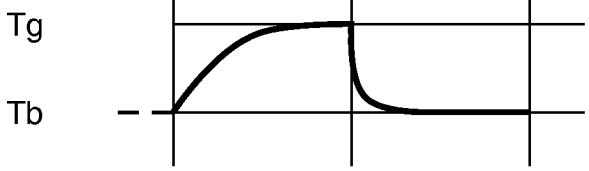

If the capacity of the liquid crystal device 120*d* changes according to the characteristic same as the transmittance shown in FIG. 4C, in a waveform of the electric current flowing to the liquid crystal device 120, as shown in FIG. 4B, an instantaneous current transitionally flows at the start timing of the voltage V1 appears. In other words a first peak Ap and a second peak Bp appear. The first peak Ap has a differential waveform involved in switching in a direction in which the potential of the pixel electrode 118*d* increased with respect to the second opposed electrode 109. The second peak Bp is involved in a capacity change (considered to be substantially the same characteristic as the transmittance change) of the liquid crystal device from the start timing of the voltage V1. Similarly, at the start timing of the voltage V2, in the current waveform, a first peak Am and a second peak Bm appear. The first peak Am has a differential waveform involved in switching in a direction in which the potential of the pixel electrode 118*d* decreases with respect to the second opposed electrode 109. The second peak Bm is involved in a capacity change of the liquid crystal device from the start timing of the voltage V2.

In the waveform of the electric current flowing to the liquid crystal device 120*d*, only the first peak Am appears at timing when the voltage is switched from the voltage V1 to the reference voltage Vc. Similarly, only the first peak Ap appears at timing when the voltage is switched from the voltage V2 to the reference voltage Vc. A reason for this is as explained below. In the embodiment, as the liquid crystal 105, liquid crystal is assumed that has characteristics that an optical response at the time when an applied voltage changes to a direction in which the applied voltage is large in terms of an absolute value (an ON direction) is slower than an optical response at the time when the applied voltage changes in a direction in which the applied voltage is small in terms of the absolute value (an OFF direction) and the optical response in the OFF direction is sufficiently fast. Therefore, the second peaks Bp and Bm do not appear (less easily appear) at these timings, which are the changes to the OFF direction.

In a period in which the voltage V1 (V2) is applied, a current waveform component excluding the first peak Ap (Am), i.e., a component indicated by hatching in FIG. 4B is a component caused by a capacity change of the liquid crystal device 120*d*. Since the capacity change of the liquid crystal device 120*d* is a change in transmittance, the current waveform component excluding the first peak Ap (Am) reflects the change in transmittance. Therefore, if control for reducing a difference between the current waveform component excluding the first peak Ap in the application period of the voltage V1 and the current waveform component excluding the first peak Am in the application period of the voltage V2 is performed, the difference in transmittance decreases and a flicker does not occur.

As an example of this control, there is control for changing the ratio of the effective voltage retained at the positive voltage and the effective voltage retained at the negative voltage. In this embodiment, a method of comparing a ratio of an application time of the positive voltage and an application time of the negative voltage is adopted. The current waveform component excluding the first peak Ap (Am) in the application period of the voltage V1 (V2) is reflected as a peak value of the second peak Bp (Bm). Therefore, in this embodiment, the current waveform component excluding the first peak Ap (Am) in the application period of the voltage V1 (V2) is specified by the peak value of the second peak Bp (Bm).

In the current waveform (the voltage waveform) shown in FIG. 4B, a zero point is important. If the voltage of the measuring signal Me and the voltage of the second opposed electrode 109 are respectively temporally fixed, an electric current flowing to the signal line 107 should be zero. Therefore, the voltage of the measuring signal Me and the voltage of the second opposed electrode 109 only has to be respectively fixed for predetermined periods and an output value of the detection circuit 61 in this fixed state only has to be used as the zero point of the electric current.

In order to compare the current waveform component (or the peak value) excluding the first peak Ap in the period in which the voltage of the measuring signal Me is V1 and the current waveform component (or the peak value) excluding the first peak Am in the period in which the voltage of the measuring signal Me is V2, conditions before a voltage is applied to the liquid crystal device 120*d* are desirably satisfied. Therefore, in this embodiment, in a period before the positive voltage V1 is applied to the pixel electrode 118*d* and a period before the negative voltage V2 is applied to the pixel electrode 118*d*, the reference voltage Vc equal to the voltage of the second opposed electrode 109 is applied to the pixel electrode 118*d* as a reset voltage to set the driving voltage for the liquid crystal device 120*d* to zero.

For example, if the voltages Vw(+) and Vw(−) corresponding the white color of the normally black mode are applied to the pixel electrode 118*d* as the reset voltage and the applied voltage to the liquid crystal device 120*d* is set in a high state, since the changing direction is the OFF direction in which the optical response is sufficiently high, the second peak less easily appears. In other words, if a voltage for setting the applied voltage to the liquid crystal device 120*d* in a small state is applied to the pixel electrode 118*d* as the reset voltage, since the change is in the ON direction, the second peak is easily specified. In this sense, the voltages Vb(+) and Vb(−) corresponding to the black color may be applied to the pixel electrode 118 as the reset voltage.

Figure 14:
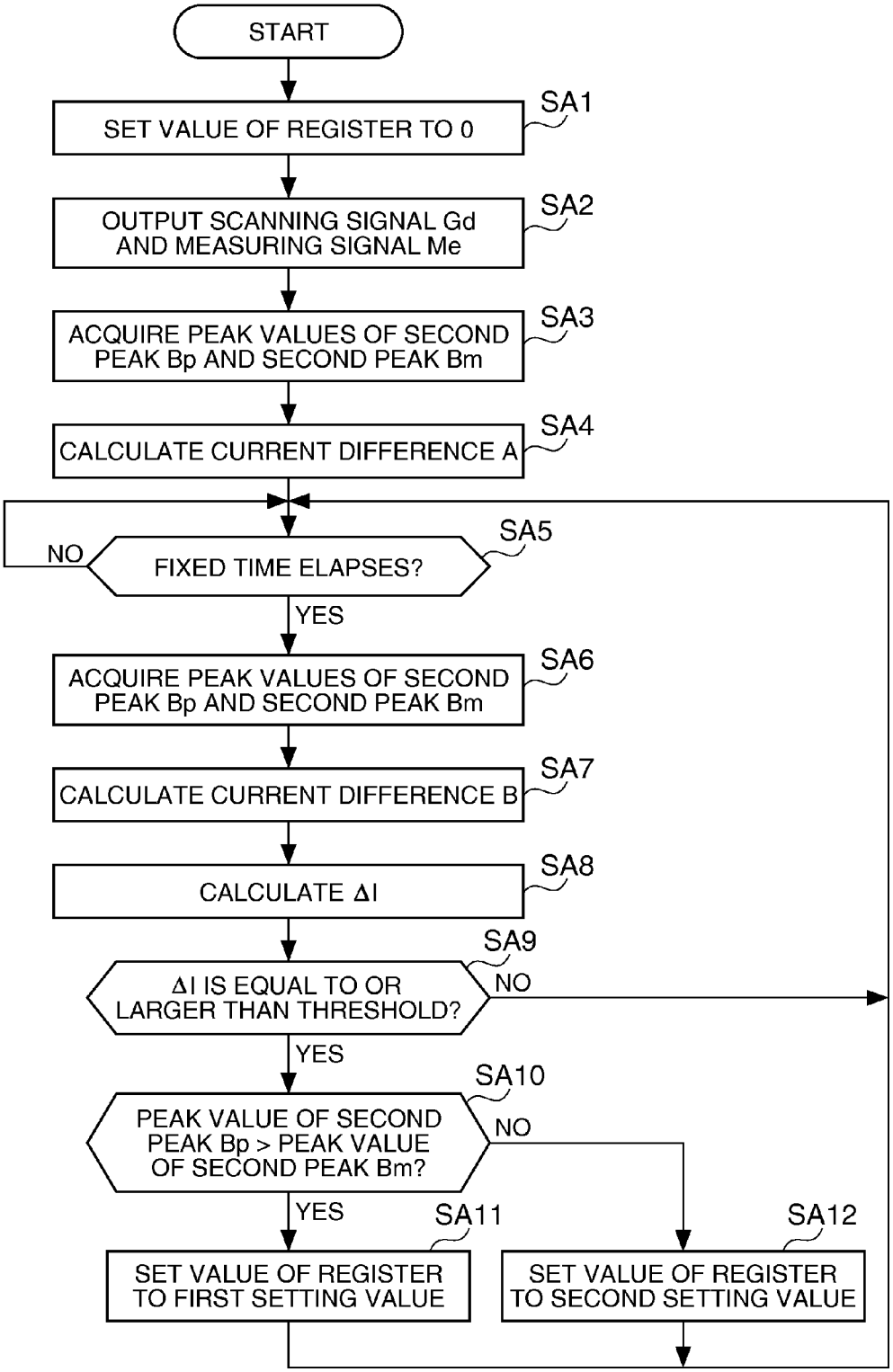
FIG. 14 is a flowchart for explaining a flow of processing by a scanning control circuit.

The operation of the scanning control circuit 52 is explained. FIG. 14 is a flowchart for explaining a flow of processing performed by the scanning control circuit 52. First, when the driving of the display panel 100 is started, the scanning control circuit 52 sets the value of the register to "0" in order to designate the output timing of the start pulse Dyb (step SA1). When the vertical synchronization signal Vs, the horizontal synchronization signal Hs, and the clock signal Clk are supplied to the scanning control circuit 52 from the external host device and the image data Vd is supplied to the data signal generating circuit 54, the scanning control circuit 52 drives the display panel 100 on the basis of the supplied signals. Since the value stored in the register is "0", the scanning control circuit 52 outputs the start pulse Dyb at the timing T. The scanning control circuit 52 outputs the scanning signal Gd and the measuring signal Me (step SA2).

Subsequently, the scanning control circuit 52 processes digital data converted by the A/D conversion circuit 56 and acquires a peak value of the second peak Bp and a peak value of the second peak Bm (step SA3). Specifically, the scanning control circuit 52 acquires a peak value (a second peak value) of the second peak Bp appearing second from the application start timing of the voltage V1 in the measuring signal Me, i.e., a value equivalent to +Ia shown in FIG. 4B. The scanning control circuit 52 acquires a peak value (a second peak value) of the second peak Bm appearing second from the application start timing of the voltage V2 in the measuring signal Me, i.e., a value equivalent to −Ic shown in FIG. 4B. Subsequently, the scanning control circuit 52 calculates a difference between the peak value of the second peak Bp and the peak value of the second peak Bm and sets a calculated value as a current difference A (step SA4).

The scanning control circuit 52 determines whether a predetermined fixed time elapses (step SA5). In this embodiment, the fixed time is set to 10 minutes. However, the fixed time is not limited to 10 minutes and may be time exceeding 10 minutes or time shorter than 10 minutes. When the fixed time does not elapse (NO in step SA5), the scanning control circuit 52 waits for the fixed time to elapse. When the scanning control circuit 52 determines that the fixed time elapses (YES in step SA5), the scanning control circuit 52 processes the digital data converted by the A/D conversion circuit 56 and acquires a peak value of the second peak Bp and a peak value of the second peak Bm (step SA6). When the scanning control circuit 52 ends the processing in step SA6, the scanning control circuit 52 calculates a difference between the peak value of the second peak Bp and the peak value of the second peak Bm and sets a calculated value as a current difference B (step SA7). The scanning control circuit 52 performs an arithmetic operation ΔI=|current difference A−current difference B| to calculate ΔI representing a difference between the current difference A and the current difference B (step SA8).

The scanning control circuit 52 determines whether ΔI calculated in step SA8 is equal to or larger than a predetermined threshold (step SA9). In this embodiment, the threshold is set to a value smaller than a value of ΔI obtained when a flicker is sensed. When the value of ΔI is smaller than the threshold (NO in step SA9), the scanning control circuit 52 determines that a flicker does not occur and returns the flow of the processing to step SA5.

When the value of ΔI is equal to or larger than the threshold (YES in step SA9), the scanning control circuit 52 sets the value of the register on the basis of the peak value of the second peak Bp and the peak value of the second peak Bm acquired in step SA6.

For example, when the display panel 100 is the display panel having the characteristics (2) in FIG. 13, the peak value of the second peak Bp is larger than the peak value of the second peak Bm. In other words, the effective voltage retained at the positive voltage is higher than the effective voltage retained at the negative voltage.

Therefore, when the peak values acquired in step SA6 are in a relation of the peak value of the second peak Bp>the peak value of the second peak Bm (YES in step SA10), the scanning control circuit 52 sets the value of the register to the first setting value (step SA11). When the first setting value is stored in the register, the application time of the positive voltage decreases and the application time of the negative voltage increases. Consequently, in the pixels 110, the effective voltage retained at the negative voltage rises and the effective voltage retained at the positive voltage falls. Therefore, as time elapses, the peak value of the second peak Bm changes in a direction in which the peak value of the second peak Bm increases to be larger than the peak value of the second peak Bp.

When the processing in step SA11 ends, the scanning control circuit 52 returns the flow of the processing to step SA5 and waits for the fixed time to elapse again. When the scanning control circuit 52 determines YES in step SA5, the scanning control circuit 52 performs the processing in step SA6 to step SA8. Subsequently, the scanning control circuit 52 performs the processing in step SA9. When the first setting value is stored in the register, the peak value of the second peak Bm increases as time elapses, and ΔI is equal to or larger than the threshold (YES in step SA9), the scanning control circuit 52 sets the value of the register on the basis of the peak value of the second peak Bp and the peak value of the second peak Bm acquired in step SA6.

The effective voltage retained at the negative voltage is high and the effective voltage retained at the positive voltage is low as explained above. Therefore, the peak values acquired in step SA6 are in a relation of the peak value of the second peak Bp<the peak value of the second peak Bm. In this case, the scanning control circuit 52 determines NO in step SA10 and sets the value of the register to the second setting value (step SA 12). When the second setting value is stored in the register, the application time of the negative voltage decreases and the application time of the positive voltage increases. Consequently, in the pixels 110, the effective voltage retained at the positive voltage rises and the effective voltage retained at the negative voltage falls. Therefore, as time elapses, the peak value of the second peak Bp changes in a direction in which the peak value of the second peak Bp increases to be larger than the peak value of the second peak Bm. When the processing in step SA10 ends, the scanning control circuit 52 returns the flow of the processing to step SA3 and repeats the processing explained above.

When the display panel 100 is the panel having the characteristics (1) in FIG. 12, i.e., the panel in which, when the value of the register is set to 0, the effective voltage retained at the negative voltage rises and the effective voltage retained at the positive voltage falls, when the value of the register is set to 0 and the display panel 100 is driven, as time elapses, the peak value of the second peak Bm changes in a direction in which the peak value of the second peak Bm increases to be larger than the peak value of the second peak Bp.

In this case, when the peak values acquired in step SA6 are in the relation of the peak value of the second peak Bp<the peak value of the second peak Bm (NO in step SA10), the scanning control circuit 52 sets the value of the register to the second setting value (step SA12). When the second setting value is stored in the register, the application time of the negative voltage decreases and the application time of the positive voltage increases. Consequently, in the pixels 110, the effective voltage retained at the positive voltage rises and the effective voltage retained at the negative voltage falls. Therefore, as time elapses, the peak value of the second peak Bp changes in a direction in which the peak value of the second peak Bp increases to be larger than the peak value of the second peak Bm.

When the processing in step SA12 ends, the scanning control circuit 52 returns the flow of the processing to step SA5 and waits for the fixed time to elapse again. When the scanning control circuit 52 determines YES in step SA5, the scanning control circuit 52 performs the processing in step SA6 to step SA8.

The scanning control circuit 52 performs the processing in step SA9. When the second setting value is stored in the register, the peak value of the second peak Bp increases as time elapses, and ΔI is equal to or larger than the threshold (YES in step SA9), the scanning control circuit 52 sets the value of the register on the basis of the peak value of the second peak Bp and the peak value of the second peak Bm acquired in step SA6. The effective value retained at the positive voltage rises and the effective voltage retained at the negative voltage falls as explained above. Therefore, the peak values acquired in step SA6 are in a relation of the peak value of the second peak Bp>the peak value of the second peak Bm. In this case, the scanning control circuit 52 determines YES in step SA10 and sets the value of the register to the first setting value (step SA11). When the first setting value is stored in the register, the application time of the positive voltage decreases and the application time of the negative voltage increases. Consequently, in the pixels 110, the effective voltage retained at the negative voltage rises and the effective voltage retained at the positive voltage falls. Therefore, as time elapses, the peak value of the second peak Bm changes in a direction in which the peak value of the second peak Bm increases to be larger than the peak value of the second peak Bp.

When the processing in step SA11 ends, the scanning control circuit 52 returns the flow of the processing to step SA3 and repeats the processing explained above.

According to this embodiment, even if a direct-current component is applied to the liquid crystal device 120, whereby a difference occurs in the effective voltage between the time when the positive voltage is applied and the time when the negative voltage is applied, the application time of the positive voltage and the application time of the negative voltage are controlled to reduce the difference in the effective voltage. Therefore, it is possible to prevent a flicker and burn-in from occurring.

Electronic Apparatus

Figure 15:
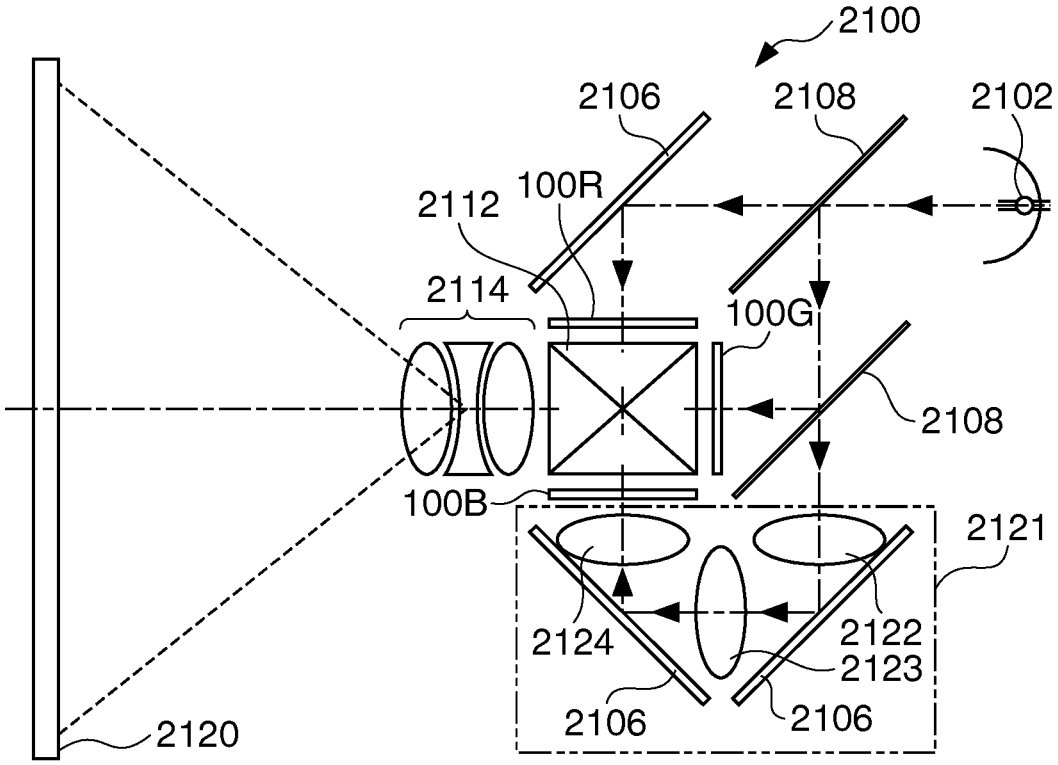
FIG. 15 is a diagram showing the configuration of a projector including the electro-optical device according to an embodiment.

An example of an electronic apparatus including the electro-optical device according to the embodiment explained above is explained. FIG. 15 is a plan view showing the configuration of a 3CCD projector including the display panel 100 of the electro-optical device 1 as a light valve. A lamp unit 2102 including a white light source such as a halogen lamp is provided on the inside of a projector 2100. In the projector 2100, light emitted from the lamp unit 2102 is separated into lights of the three primary colors of R (red), G (green), and B (blue) by three mirrors 2106 and two dichroic mirrors 2108 arranged on the inside. The lights are respectively guided to light valves 100R, 100G, and 100B corresponding to the primary colors. The light of the B color has a long optical path compared with the other lights of the colors R and G. Therefore, to prevent a loss of the light of the B color, the light of the B color is guided via a relay lens system 2121 including an incident lens 2122, a relay lens 2123, and an emission lens 2124.

The configuration of the light valves 100R, 100G, and 100B are the same as the configuration of the display panel 100 in the embodiment. The light valves 100R, 100G, and 100B are respectively driven by the image data Vd corresponding to the colors R, G, and B supplied from an external host device (not shown in the figure). Lights respectively modulated by the light valves 100R, 100G, and 100B are made incident on the dichroic prism 2112 from three directions. In the dichroic prism 2112, the lights of the R and B colors are refracted at 90 degrees and, on the other hand, the light of the G color travels straight. Therefore, after images of the respective colors are combined, since the combined images are normally rotated and projected in enlargement by a lens unit 2114, a color image is displayed on a screen 2120.

Transmitted image of the light valves 100R and 100B are projected after being reflected by the dichroic prism 2112. On the other hand, a transmitted image of the light valve 100G is directly projected. Therefore, images formed by the light valves 100R and 100B and an image formed by the light valve 100G are in a relation of mirror reversal.

Besides the projector explained with reference to FIG. 15, examples of the electronic apparatus include a television of a rear projection type and apparatuses of a direct view type such as a cellular phone, a personal computer, a monitor of a video camera, a car navigation apparatus, a pager, an electronic organizer, an electric calculator, a word processor, a work station, a television phone, a POS terminal, a digital still camera, and an apparatus including a touch panel. It goes without saying that the electro-optical device according to the embodiment of the invention can be applied to these various electronic apparatuses.

Modifications

The embodiment of the invention is explained above. However, the invention is not limited to the embodiment and can be carried out in various forms. For example, the embodiment may be modified as explained below to carry out the invention. The embodiment and modifications explained below may be combined with each other.

Modification 1

In the embodiment, the normally black mode for displaying the black color if an effective value of a voltage retained in the liquid crystal device 120 is close to zero (or a value around zero) is adopted. However, a normally white mode for displaying the white color if an effective value of a voltage retained in the liquid crystal device 120 is close to zero (or a value around zero) may be adopted.

Modification 2

In the embodiment, the scanning lines 113 are always at the H level and the measuring signal Me is always output. However, in a period in which the peak values are acquired in step SA3 and step SA6, the scanning lines 113 may be set to the H level to output the measuring signal Me. In periods other than the period in which the peak values are acquired, the scanning lines 113 may be set to the L level not to output the measuring signal Me.

Modification 3

In the embodiment, the voltage V1 is the positive voltage between the voltage Vw(+) and the reference voltage Vc. The voltage V2 is the negative voltage between the voltage Vw(−) and the reference voltage Vc. However, when the display panel 100 is the transmission type like the projector 2100, the voltage V1 may be the voltage Vw(+) and the voltage V2 may be the voltage Vw(−). When the display panel 100 is the reflection type, the voltage V1 may be the voltage Vb(+) and the voltage V2 may be the voltage Vb(−).

Modification 4

In the embodiment, the ratio of the retaining time of the positive voltage and the retaining time of the negative voltage is changed, whereby the ratio of the effective voltage retained at the positive voltage and the effective voltage retained at the negative voltage is changed such that ΔI is fit within a fixed range. A method of fitting the ΔI within the fixed range is not limited to the method of the embodiment explained above.

For example, when the scanning control circuit 52 starts the driving of the display panel 100, if gradation is the same, the positive data signal Vid and the negative data signal Vid are set in a symmetrical relation with respect to the reference voltage Vc. In step SA11, the scanning control circuit 52 changes a voltage ratio of the positive voltage and the negative voltage instead of the processing for changing the application time of the positive voltage and the application time of the negative voltage. Specifically, if a gradation value is the same, the scanning control circuit 52 set the amplitude of the data signal Vid from the reference voltage Vc to be small on the positive polarity side and large on the negative polarity side. In step SA12, if the gradation value is the same, the scanning control circuit 52 sets the amplitude of the data signal Vid from the reference voltage Vc to be large on the positive polarity side and small on the negative polarity side. In this modification, as in the embodiment, it is possible to change the ratio of the effective voltage of the positive voltage and the effective voltage of the negative voltage.

Modification 5

In the embodiment, the dummy pixels 111 are provided around the display area A1 to surround the display area A1. However, arrangement positions of the dummy pixels 111 are not limited to the arrangement in the embodiment. For example, the dummy pixels 111 may be provided along the pixels in the first row to be adjacent to the pixels 110 in the first row and the first column to the first row and the 640th column and may be provided along the pixels in the 480th row to be adjacent to the pixels 110 in the 480th row and the first column to the 480th row and 640th column. The dummy pixels 111 may be provided along the pixels in the first row to be adjacent to the pixels 110 in the first row and the first column to the 480th row and the first column and may be provided along the pixels in the 640th row to be adjacent to the pixels 110 in the first row and the 640th column to the 480th row and 640th column. In short, the arrangement positions and the number of the dummy pixels 111 are not limited to the arrangement positions and the number shown in FIG. 2. The dummy pixels 111 only have to be provided around the display area A1. The arrangement of the dummy pixels 111 may be along only one side of the display area A1. However, the dummy pixels 111 are desirably arranged along two or more sides of the display area A1 and more desirably arranged along the four sides of the display area A1. When the dummy pixels 111 are arranged along the two or more sides, compared with the configuration in which the dummy pixels 111 are arranged along only one side of the display area A1, the number of the dummy pixels 111 related to measurement of an electric current increases. Therefore, the influence of the difference in characteristics of each of the dummy pixels 111 decreases (characteristics of pixels in different places can be obtained).

Modification 6

Figure 16:
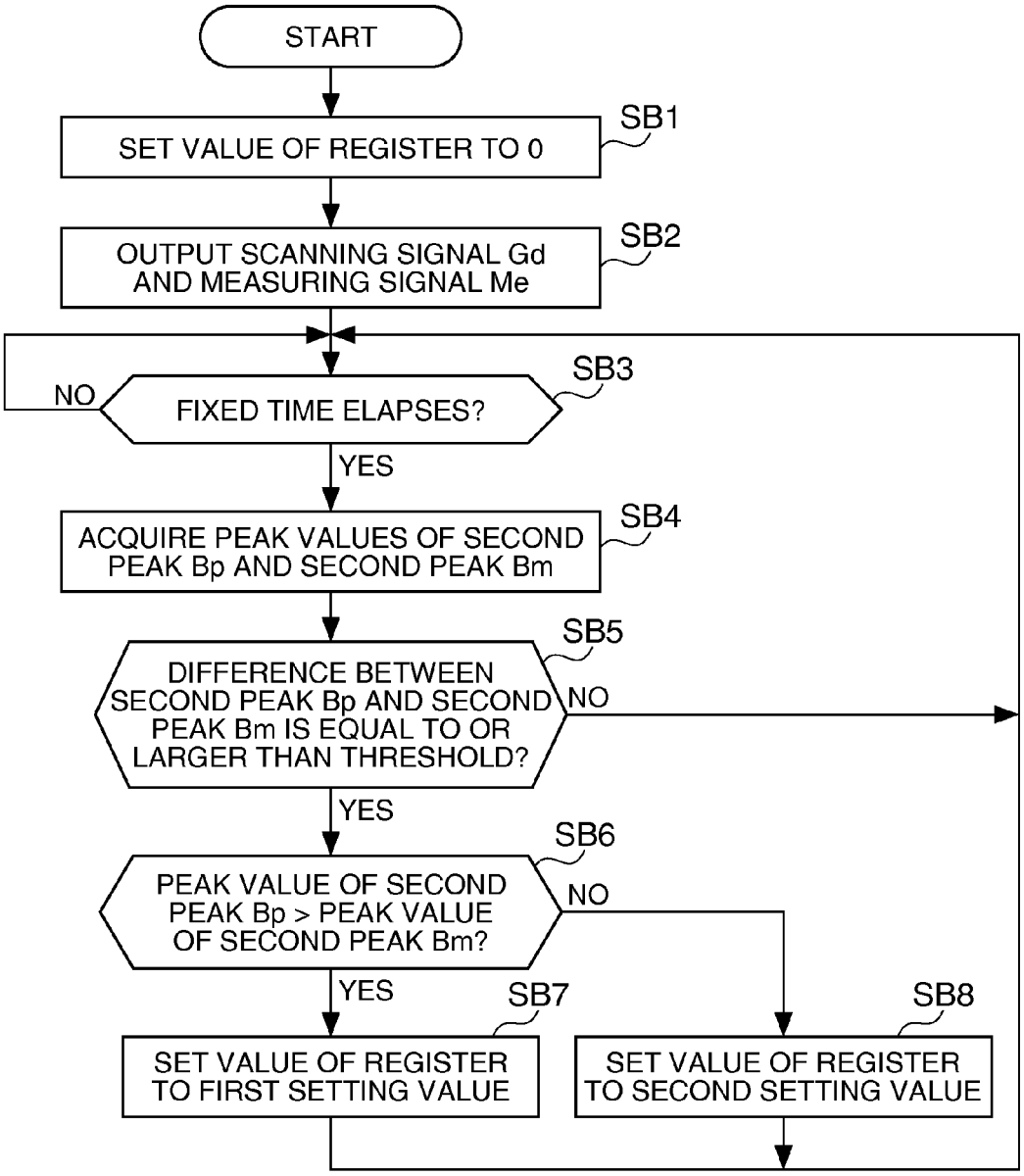
FIG. 16 is a flowchart for explaining a flow of processing by the scanning control circuit according to a modification.

In the embodiment, the scanning control circuit 52 calculates ΔI in step SA8. When ΔI is equal to or larger than the threshold, the scanning control circuit 52 changes the application time of the positive voltage and the application time of the negative voltage to reduce the difference between the effective voltage at the time when the positive voltage is retained and the effective voltage at the time when the negative voltage is retained. However, a flow of processing for controlling the application times is not limited to the flow of the processing shown in FIG. 14 and may be, for example, a flow of processing shown in FIG. 16. The processing shown in FIG. 16 is different from the processing in the embodiment in that, rather than calculating the current differences A and B and ΔI, the scanning control circuit 52 calculates a difference between the peak value of the second peak Bp and the peak value of the second peak Bm and changes the value of the register on the basis of the difference between the peak values.

Specifically, processing in step SB1 to SB2 is the same as the processing in steps SA1 to SA2. Processing in steps SB3 to SB4 is the same as the processing in steps SA5 to SA6. In this modification, when the difference between the peak value of the second peak Bp and the peak value of the second peak Bm acquired in step SB4 is equal to or larger than a predetermined threshold (YES in step SB5), the scanning control circuit 52 performs processing for changing the value of the register. Processing in steps SB6 to SB8 is the same as the processing in steps SA10 to SA12.

Modification 7

In the embodiment, the measuring signal Me is supplied to the dummy pixels 111. However, in periods other than the period in which the peak value of the second peak Bp and the peak value of the second peak Bm are acquired, the gradation of the dummy pixels 111 may be set to gradation same as the gradation of the pixels 110 adjacent to the dummy pixels 111.

Figure 17:
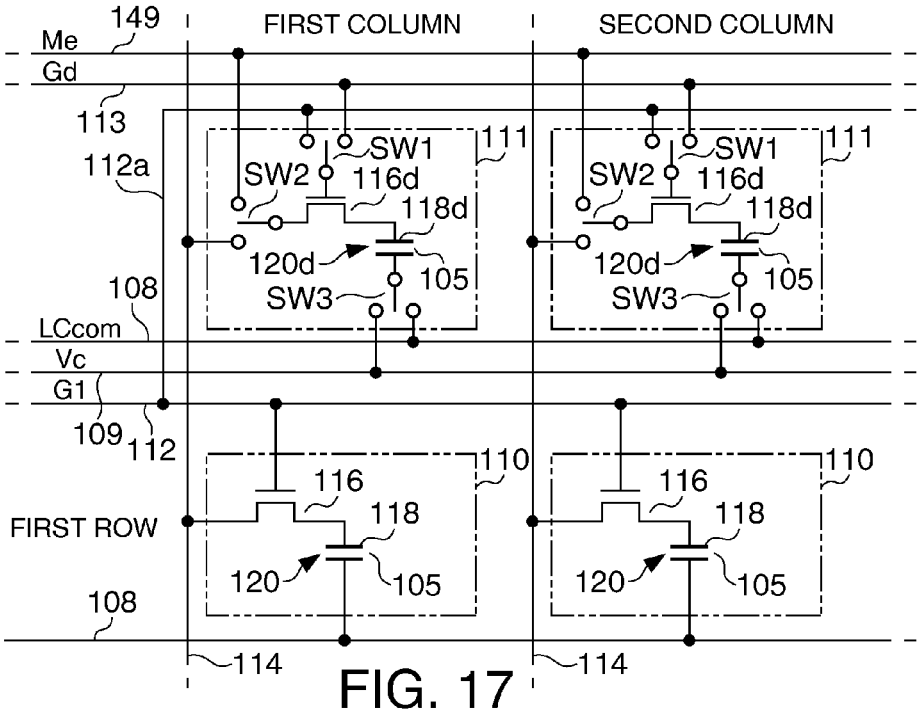
FIG. 17 is a diagram showing the configurations of pixels and dummy pixels according to a modification.

FIG. 17 is a diagram showing the configurations of the dummy pixels 111 and the pixels 110 according to this modification. In this modification, the dummy pixel 111 includes switches SW1 to SW3. One of input terminals of the switch SW1 is connected to a scanning line 112*a* branching from the scanning line 112 in the first row. The other input terminal is connected to the scanning line 113. An output end of the switch SW1 is connected to the gate electrode of the TFT 116*d*. One of input ends of the switch SW2 is connected to the data line 114 in the first column. The other input end is connected to the measuring signal line 149. An output end of the switch SW2 is connected to the source electrode of the TFT 116*d*. One of input ends of the switch SW3 is connected to the first opposed electrode 108. The other input end is connected to the second opposed electrode 109. An output end of the switch SW3 is connected to the drain electrode of the TFT 116*d*.

In this configuration, when the peak values are acquired in step SA3 and step SA6, in a predetermined period, the output end of the switch SW1 is connected to the scanning line 113, the output end of the switch SW2 is connected to the measuring signal line 149, and the output end of the switch SW3 is connected to the second opposed electrode 109. Consequently, in the period in which the peak value of the second peak Bp and the peak value of the second peak Bm are acquired in step SA3 and step SA6, the measuring signal Me is supplied to the dummy pixels 111.

On the other hand, in periods other than the period in which the peak value of the second peak Bp and the peak value of the second peak Bm are acquired, the output end of the switch SW1 is connected to the scanning line 112*a*, the output end of the switch SW2 is connected to the data line 114, and the output end of the switch SW3 is connected to the first opposed electrode 108. Consequently, in the periods other than the period in which the peak value of the second peak Bp and the peak value of the second peak Bm are acquired, the data signal Vid same as the data signal Vid to the pixel 110 in the first row is supplied to the dummy pixel 111 adjacent to the pixel 110 in the first row. The gradation of the pixel 110 in the first row and the gradation of the dummy pixel 111 adjacent to the pixel 110 in the first row are set to the same gradation.

Modification 8

In the embodiment, the first opposed electrode 108 and the second opposed electrode 109 are insulated from each other. However, the first opposed electrode 108 and the second opposed electrode 109 may be electrically connected to form one common electrode. In this configuration, the voltage LCcom is applied to the first opposed electrode 108. According to this modification, the number of wires for connecting the display panel 100 and the control circuit 50 can be reduced from the number of wires in the embodiment.

Modification 9

In the embodiment, the measuring signal Me and the voltage setting signal Vset are output from the scanning control circuit 52. However, a configuration for outputting the measuring signal Me and the voltage setting signal Vset is not limited to this configuration and may be, for example, a configuration shown in FIG. 18.

Figure 18:
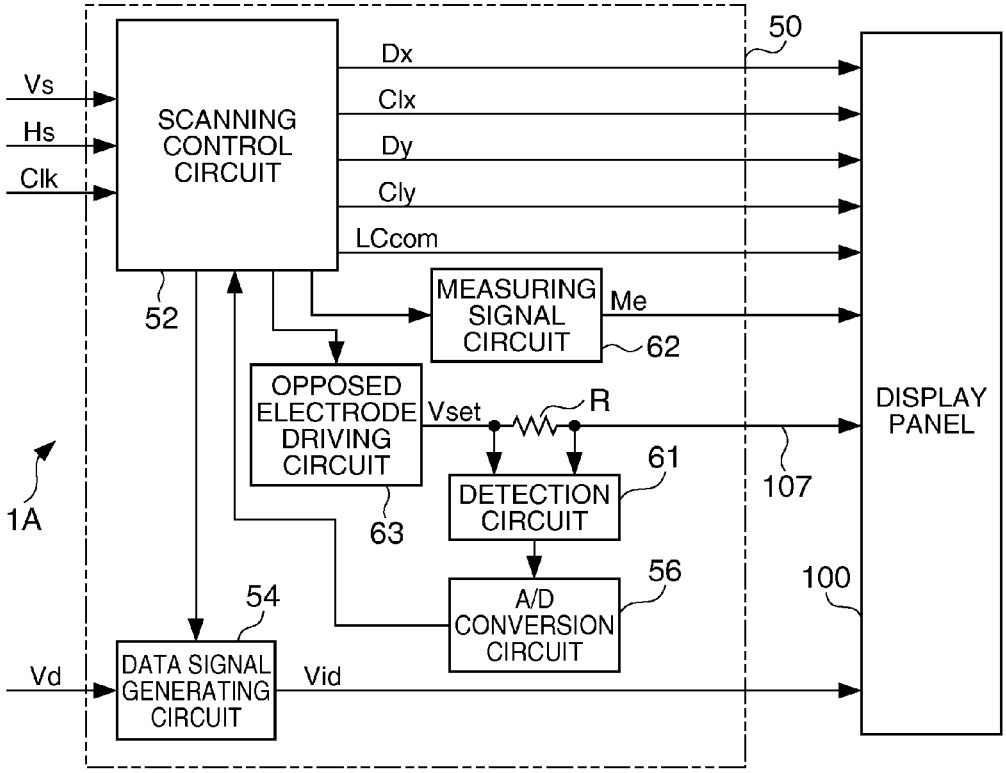
FIG. 18 is a diagram showing the configuration of an electro-optical device according to a modification.

FIG. 18 is a diagram showing the configuration of an electro-optical device 1A according to a modification of the invention. The electro-optical device 1A includes a measuring signal circuit 62 and an opposed electrode driving circuit 63. The measuring signal circuit 62 is a circuit that outputs the measuring signal Me. The measuring signal circuit 62 is connected to the measuring signal line 149. The measuring signal circuit 62 is controlled by the scanning control circuit 52 to output the measuring signal Me. The opposed electrode driving circuit 63 is connected to the second opposed electrode 109. The opposed electrode driving circuit 63 is controlled by the scanning control circuit 52 to output the voltage setting signal Vset.

In this modification, as in the embodiment, it is possible to supply a measuring signal to the measuring signal line 149 and apply the voltage Vset to the second opposed electrode 109. The measuring signal line 149 may be connected to the data line driving circuit 140 to supply the measuring signal Me from the data line driving circuit 140 to the measuring signal line 149.

The entire disclosure of Japanese Patent Application No. 2011-202251, filed Sep. 15, 2011 is expressly incorporated by reference herein.

What is claimed is:

1. A liquid crystal display device comprising:

a display pixel in which liquid crystal is held between a first electrode and a common electrode;

a driving circuit that temporally alternately applies, to the first electrode, a first voltage further on a high-order side than a predetermined reference voltage and corresponding to gradation of the display pixel and a second voltage further on a low-order side than the predetermined reference voltage and corresponding to the gradation and applies a predetermined voltage to the common electrode, the first voltage being positive and the second voltage being negative;

a dummy pixel in which liquid crystal is held between a second electrode and the common electrode;

a measuring signal circuit that supplies, to the second electrode, a measuring signal for applying the first voltage further on the high-order side than the reference voltage and the second voltage further on the low-order side than the reference voltage while temporally shifting the first and second voltages; and a control circuit that changes a ratio of effective voltages of the positive voltage and the negative voltage, which are applied to the first electrode by the driving circuit, on the basis of a first electric current obtained by excluding an instantaneous current due to the application of the first voltage from an electric current flowing to the common electrode after the first voltage is applied to the second electrode and a second electric current obtained by excluding an instantaneous current due to the application of the second voltage from an electric current flowing to the common electrode after the second voltage is applied to the second electrode.

2. The liquid crystal display device according to claim 1, wherein the control circuit changes the ratio of the effective voltages of the positive voltage and the negative voltage applied to the first electrode to reduce a difference between the first electric current and the second electric current to be smaller than a predetermined threshold.

3. The liquid crystal display device according to claim 1, wherein the control circuit changes application times of the positive voltage and the negative voltage applied to the first electrode to reduce a difference between the first electric current and the second electric current to be smaller than a predetermined threshold.

4. The liquid crystal display device according to claim 1, wherein the control circuit changes a voltage ratio of the positive voltage and the negative voltage applied to the first electrode to reduce a difference between the first electric current and the second electric current to be smaller than a predetermined threshold.

5. The liquid crystal display device according to claim 1, wherein the measuring signal is a signal for applying a third voltage, which is the same as the voltage applied to the common electrode, to the second electrode between a period in which the first voltage is applied and a period in which the second voltage is applied.

6. The liquid crystal display device according to claim 1, wherein the common electrode includes a first common electrode that holds the liquid crystal between the first common electrode and the first electrode and a second common electrode that holds the liquid crystal between the second common electrode and the second electrode, the first common electrode and the second common electrode being insulated from each other, and the control circuit changes the ratio of the effective voltages of the positive voltage and the negative voltage, which are applied to the first electrode by the driving circuit, on the basis of an electric current obtained by excluding an instantaneous current due to the application of the first voltage from an electric current flowing to the second common electrode after the first voltage is applied to the second electrode and an electric current obtained by excluding an instantaneous current due to the application of the second voltage from an electric current flowing to the second common electrode after the second voltage is applied to the second electrode.

7. The liquid crystal display device according to claim 1, wherein a period in which the first voltage of the measuring signal is applied to the second electrode is longer than a period in which the positive voltage is applied to the first electrode and a period in which the second voltage of the measuring signal is applied to the second electrode is longer than a period in which the negative voltage is applied to the first electrode.

8. The liquid crystal display device according to claim 1, wherein, in the dummy pixel, the measuring signal is supplied to the second electrode from the measuring signal circuit in a predetermined period and, outside the period, the positive voltage and the negative voltage applied to the display pixel adjacent to the dummy pixel are temporally alternately applied to the second electrode from the driving circuit.

9. An electronic apparatus comprising the liquid crystal display device according to claim 1.

10. An electronic apparatus comprising the liquid crystal display device according to claim 2.

11. An electronic apparatus comprising the liquid crystal display device according to claim 3.

12. An electronic apparatus comprising the liquid crystal display device according to claim 4.

13. An electronic apparatus comprising the liquid crystal display device according to claim 5.

14. An electronic apparatus comprising the liquid crystal display device according to claim 6.

15. An electronic apparatus comprising the liquid crystal display device according to claim 7.

16. An electronic apparatus comprising the liquid crystal display device according to claim 8.

17. A driving method for a liquid crystal display device including a display pixel in which liquid crystal is held between a first electrode and a common electrode and a dummy pixel in which liquid crystal is held between a second electrode and the common electrode, the driving method comprising:

temporally alternately applying, to the first electrode, a first voltage further on a high-order side than a predetermined reference voltage and corresponding to gradation of the display pixel and a second voltage further on a low-order side than the predetermined reference voltage and corresponding to the gradation and applying a predetermined voltage to the common electrode, the first voltage being positive and the second voltage being negative;

supplying, to the second electrode, a measuring signal for applying the first voltage further on the high-order side than the reference voltage and the second voltage further on the low-order side than the reference voltage while temporally shifting the first and second voltages; and changing a ratio of effective voltages of the positive voltage and the negative voltage, which are applied to the first electrode, on the basis of a first electric current obtained by excluding an instantaneous current due to the application of the first voltage from an electric current flowing to the common electrode after the first voltage is applied to the second electrode and a second electric current obtained by excluding an instantaneous current due to the application of the second voltage from an electric current flowing to the common electrode after the second voltage is applied to the second electrode.

* * * * *